US009783982B2

(12) United States Patent
Dinmore et al.

(10) Patent No.: US 9,783,982 B2
(45) Date of Patent: Oct. 10, 2017

(54) STAY-IN-PLACE FASCIA FORMS AND METHODS AND EQUIPMENT FOR INSTALLATION THEREOF

(71) Applicants: Gary Michael Dinmore, Skillman, NJ (US); John Stanley Deerkoski, Warwick, NY (US)

(72) Inventors: Gary Michael Dinmore, Skillman, NJ (US); John Stanley Deerkoski, Warwick, NY (US)

(73) Assignee: Precasteel, LLC, Skillman, NJ (US)

( * ) Notice: Subject to any disclaimer, the term of this patent is extended or adjusted under 35 U.S.C. 154(b) by 0 days.

(21) Appl. No.: 14/099,510

(22) Filed: Dec. 6, 2013

(65) Prior Publication Data

US 2015/0159386 A1 Jun. 11, 2015
US 2017/0002574 A9 Jan. 5, 2017

Related U.S. Application Data

(60) Provisional application No. 61/734,418, filed on Dec. 7, 2012.

(51) Int. Cl.
*E04B 5/36* (2006.01)
*E01D 21/00* (2006.01)
(Continued)

(52) U.S. Cl.
CPC ..... *E04B 5/36* (2013.01); *E01D 21/00* (2013.01); *E04B 5/32* (2013.01); *E04B 5/40* (2013.01);
(Continued)

(58) Field of Classification Search
CPC ..... E04B 2005/322; E04B 5/32; E04B 5/36; E04D 13/15
(Continued)

(56) References Cited

U.S. PATENT DOCUMENTS 12,676 A 4/1855 Ellis
481,243 A * 8/1892 Orr ..... 52/781.3
(Continued)

FOREIGN PATENT DOCUMENTS

DE 299 08 482 01 U1 9/1999
EP 0732307 A2 9/1996
(Continued)

OTHER PUBLICATIONS

International Search Report and Written Opinion, PCT Application No. PCT/US2013/073754, dated Mar. 26, 2014, 6 pp.

*Primary Examiner* — Michael Safavi
(74) *Attorney, Agent, or Firm* — Rita C. Chipperson; Chipperson Law Group, P.C.

(57) ABSTRACT

Stay-in-place fascia forms and methods and equipment for installing thereof. A concrete form includes a vertical component and a horizontal component, the vertical component located substantially perpendicular to the horizontal component. Also, the form includes an interior surface, at least a portion of the interior surface providing a form for supporting uncured concrete; wherein the uncured concrete forms a concrete structural portion upon curing of the uncured concrete; and wherein the interior surface remains attached to the concrete structural portion after curing. The form may include inserts and compatible form attachments. Also, forms including recesses may be utilized to reduce the weight thereof. Lifting equipment and accessories may be utilized to lift the form from a form holder and set same in place. Forms contain the work area as soon as it is installed to minimize fall hazards and the time, costs, and downtime associated with installation of safety measures.

21 Claims, 22 Drawing Sheets

(51) Int. Cl.

| | |
|---|---|
| ***E04B 5/40*** | (2006.01) |
| ***E04G 13/04*** | (2006.01) |
| *E04B 5/32* | (2006.01) |
| *E04C 5/06* | (2006.01) |
| *E04G 19/00* | (2006.01) |

(52) U.S. Cl.
CPC ..... *E04G 13/04* (2013.01); *E04B 2005/322* (2013.01); *E04C 5/0627* (2013.01); *E04G 19/003* (2013.01)

(58) Field of Classification Search
USPC ..... 52/94, 95, 96, 610, 258, 259, 236.8
See application file for complete search history.

(56) References Cited

U.S. PATENT DOCUMENTS

| | | | | | |
|---|---|---|---|---|---|
| 1,547,012 | A | * | 7/1925 | Arnn | 52/351 |
| 1,821,355 | A | * | 9/1931 | Murray | 52/336 |
| 2,148,189 | A | | 8/1937 | Curran | |
| 2,390,379 | A | * | 12/1945 | Martin | 52/16 |
| 2,621,617 | A | * | 12/1952 | Piatt | 52/94 |
| 2,649,059 | A | * | 8/1953 | Mercier | 52/81.6 |
| 2,921,354 | A | | 3/1956 | Pankey et al. | |
| 3,089,281 | A | * | 5/1963 | Borges | 52/86 |
| 3,133,377 | A | * | 5/1964 | Jackson | 52/24 |
| 3,272,096 | A | | 9/1966 | Lum | |
| 3,315,578 | A | | 4/1967 | Wesch et al. | |
| 3,323,266 | A | * | 6/1967 | Dalkas | 52/302.3 |
| 3,587,964 | A | | 6/1971 | Cork | |
| 3,842,552 | A | | 10/1974 | Hudson | |
| 4,048,772 | A | * | 9/1977 | Gaul | 52/136 |
| 4,067,166 | A | * | 1/1978 | Sheahan | 52/592.6 |
| 4,175,363 | A | * | 11/1979 | Moskowitz | 52/294 |
| 4,260,296 | A | * | 4/1981 | Hilfiker | 405/284 |
| 4,426,176 | A | * | 1/1984 | Terada | 405/285 |
| 4,967,528 | A | | 11/1990 | Doran | |
| 5,060,438 | A | * | 10/1991 | O'Rourke | 52/371 |
| 5,065,561 | A | | 11/1991 | Mason | |
| 5,471,811 | A | | 12/1995 | House et al. | |
| 5,669,194 | A | * | 9/1997 | Colasanto et al. | 52/236.8 |
| 5,845,445 | A | | 12/1998 | Blackbeard | |
| 6,099,942 | A | * | 8/2000 | Yakushinji | 428/192 |
| 6,295,782 | B1 | | 10/2001 | Fyfe | |
| 6,634,148 | B2 | | 10/2003 | Shidler | |
| 6,792,728 | B2 | * | 9/2004 | Toulemonde et al. | 52/251 |
| 6,878,323 | B2 | | 4/2005 | Fyfe | |
| 2009/0184230 | A1 | | 7/2009 | Carney, Jr. | |
| 2009/0218474 | A1 | | 9/2009 | Bowman | |
| 2010/0024331 | A1 | * | 2/2010 | Stiffler et al. | 52/236.8 |
| 2011/0173905 | A1 | | 7/2011 | Hanback | |
| 2012/0017522 | A1 | | 1/2012 | Hanback | |
| 2012/0056344 | A1 | | 3/2012 | Richardson et al. | |

FOREIGN PATENT DOCUMENTS

| | | |
|---|---|---|
| EP | 1 881 111 A2 | 1/2008 |
| WO | 9404756 A1 | 3/1994 |

* cited by examiner

STAY-IN-PLACE FASCIA FORMS AND METHODS AND EQUIPMENT FOR INSTALLATION THEREOF

BACKGROUND OF THE INVENTION

Embodiments of the present invention generally relate to stay-in-place fascia forms and methods and equipment for installation thereof. Conventional construction methods for building bridges are known including those which use bridge brackets, scaffolding, and many other types of form support to support the loads from wet concrete. Fascia formwork is typically made from wood or steel and requires removal after the bridge is constructed. Known apparatus and methods involve substantial issues of safety and maintenance and protection of traffic ("MPT"). Known apparatus and methods also incur substantial labor cost, material cost, and costs associated with handling and disposal of such materials.

A common method of bridge building includes the use of bridge brackets installed along the fascia of the bridge and at or near the bottom of the bridge deck. Such brackets are typically installed with wooden forms that require removal after concrete placement. This method is labor intensive and results in high material costs. Moreover, disposal costs, MPT costs (if applicable), and safety costs are incurred.

Concrete paving machines are also known for bridge construction. Such machines use truss units to carry the machine and associated parts. They also use bogie wheel, rails, and screw jack adjustors to facilitate the paving process.

SUMMARY OF THE INVENTION

Briefly stated, in one aspect of the present invention, a concrete form is disclosed. This concrete form includes a vertical component and a horizontal component, the vertical component located substantially perpendicular to the horizontal component. Also, the form includes an interior surface, at least a portion of the interior surface providing a form for supporting uncured concrete; wherein the uncured concrete forms a concrete structural portion upon curing of the uncured concrete; and wherein the interior surface remains attached to the concrete structural portion after formation.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1A:
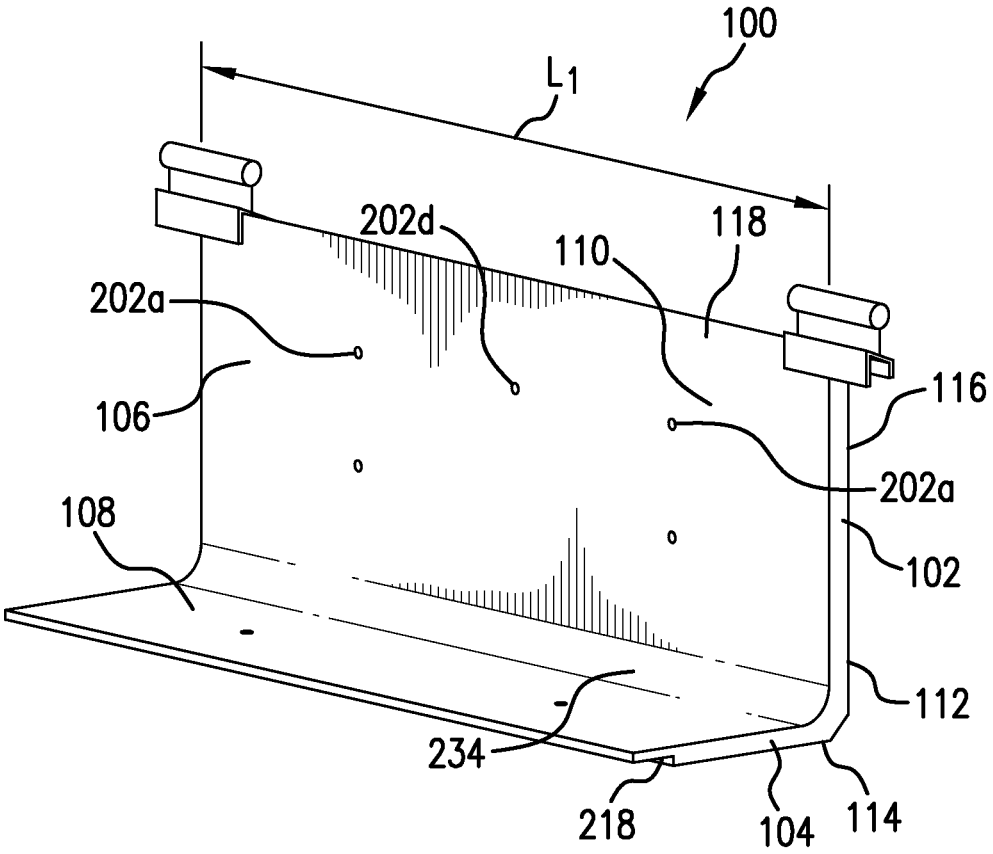
FIGS. 1A and 1B depict perspective and plan views of a stay-in-place fascia form in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "a form" may include a plurality of forms. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Figure 1B:
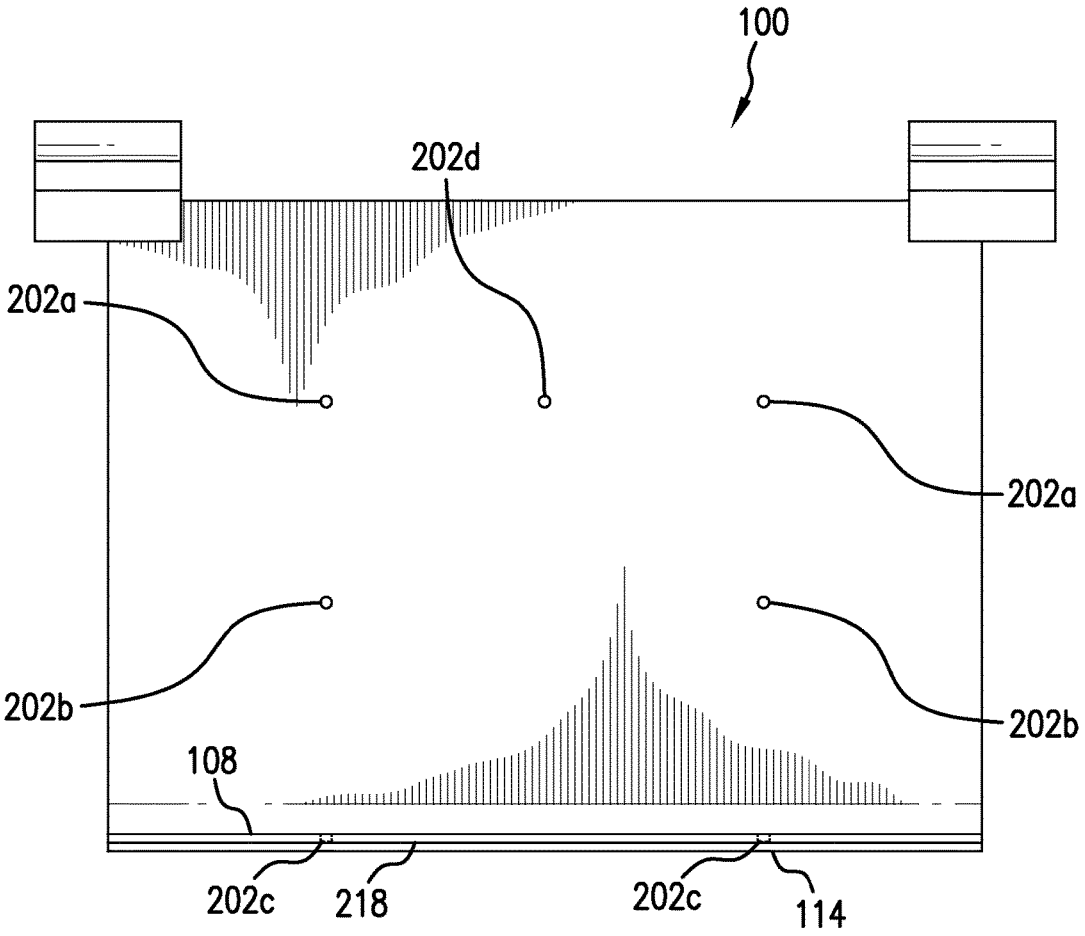

Referring now to FIGS. 1A and 1B, depicted is an exemplary stay-in-place fascia form 100 in accordance with one embodiment of the present invention. This exemplary form 100 is utilized as a form for supporting uncured concrete, and, after the concrete has cured, form 100 remains an integral part of the structure formed thereby. This exemplary form 100 is intended for use in the construction of new bridges, specifically, bridge barriers such as traffic barriers. Although the described use of form 100 is new bridge construction and barriers for same, the systems and methods of the present invention are not limited to use for building bridges. They may be incorporated for the construction of other structures or other uses including, without limitation, bridge repair and/or rehabilitation, parapet construction, building construction, and the like.

When used for bridge building, form 100 contains the work area as soon as it is installed as discussed in greater detail below, which minimizes or eliminates fall hazards, thereby eliminating the time, costs (e.g., labor costs, removal costs, disposal costs, etc.), and downtime associated with installation of safety measures that are typically required (e.g., formwork, scaffolding, road closure, etc.) to contain the work area. That is, minimal or zero excess materials are needed to contain the work area since the form performs this task while also remaining in place after construction to become part of the structure being built. Also, the disruption of traffic or other environmental considerations beneath the structure being built is minimized as all work can be safely performed from atop the structure.

Figure 2:
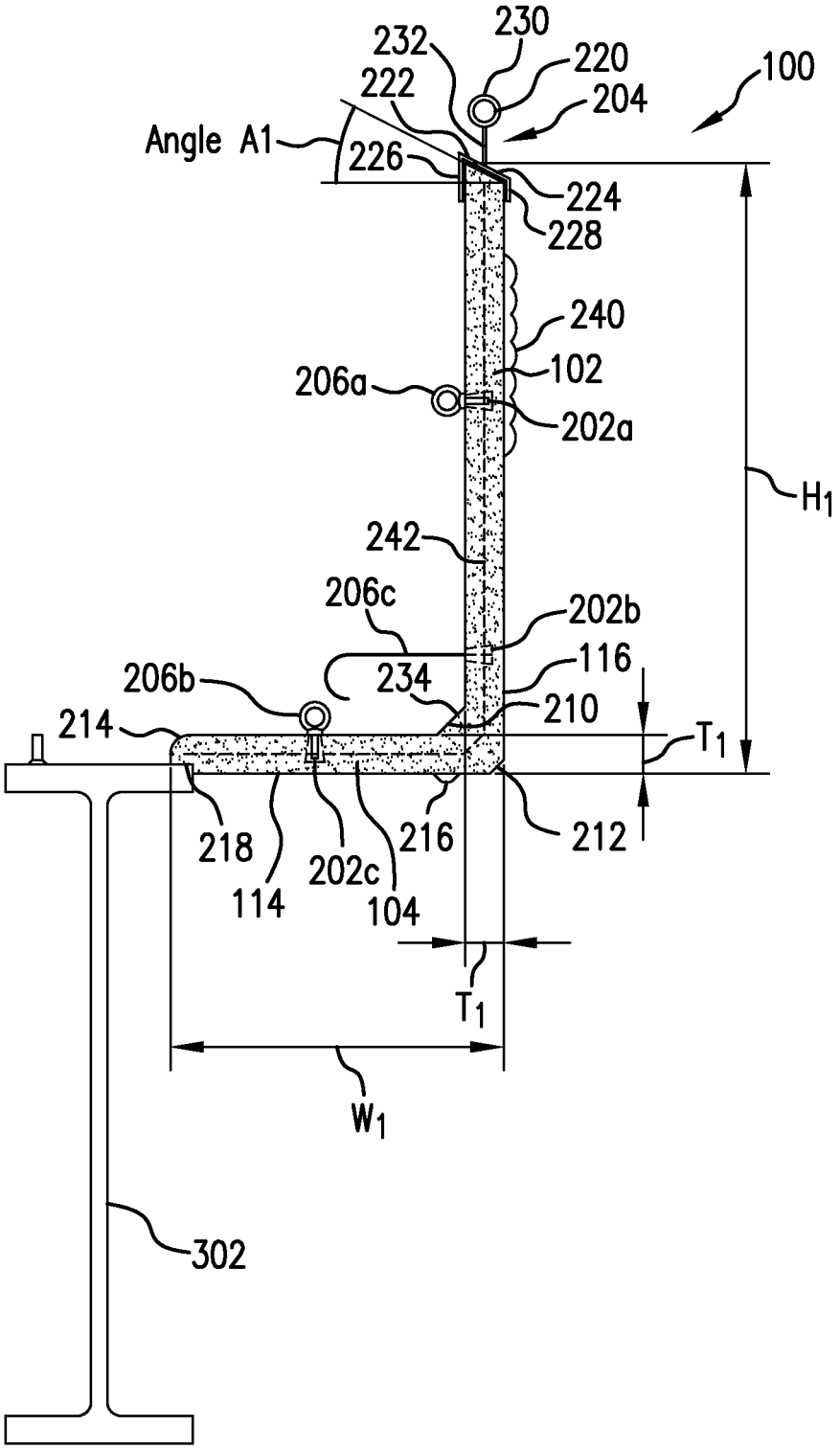
FIG. 2 depicts a side view of the fascia form of FIGS. 1A and 1B positioned atop the outer edge of a structural member in accordance with one embodiment of the present invention.

Now referring to FIGS. 1A, 1B, and 2, form 100 is a relatively thin, substantially L-shaped panel that includes vertical component 102 and horizontal component 104. In the depicted embodiment, vertical component 102 is located substantially perpendicular to horizontal component 104, however, alternate orientations may be substituted.

Vertical and horizontal components 102 and 104, respectively, have thicknesses $T_1$ of approximately two inches (2"), however, alternate thicknesses may be substituted without departing from the scope of the present invention. Also, embodiments are envisioned in which the thicknesses of the vertical and horizontal components are not equal.

The height $H_1$ of form 100 is approximately forty four inches (44"), the width $W_1$ is approximately two feet (2'), and the length $L_1$ is approximately sixty inches (60"), however, varied dimensions may be substituted to accommodate, for example, desired size of the structure being built as well as material strength and geometric boundaries. For example, alternate embodiments are envisioned in which width $W_1$ is approximately twelve inches (12"), but the invention is not so limited.

As best seen in FIG. 2, in the depicted embodiment of the present invention, upwardly facing surface 222 of vertical component 102 inclines upwardly and inwardly toward interior surface 106 at an angle of approximately thirty degrees (30°), however, varying angles may be substituted.

Form 100 has an interior surface 106 that includes upwardly facing surface 108 of horizontal component 104, inwardly facing surface 110 of vertical component 102, and inwardly facing surface 234 of joining component 210. In the exemplary embodiment of the present invention shown in FIG. 2, joining component 210 extends at an angle of 45 degrees) (45°) relative to said inwardly facing surface 110 of said vertical component and said upwardly facing surface 108 of said horizontal component. However, alternate configurations may be substituted without departing from the scope hereof.

Interior surface 106 provides a form for supporting uncured concrete as discussed in greater detail below. Once the concrete has cured, form 100 remains in place and forms a structural portion of the bridge being built or remains in place as a permanent part that does not have structural significance. That is, interior surface 106 remains attached to the cured concrete after curing/formation of same. In this case, exterior surface 112 becomes an exterior surface of the bridge. In some embodiments such as the one depicted in FIG. 2, exterior surface 112 includes one or more ornamental features 240 or other aesthetics to provide a decorative exterior or surface for the structure. Exterior surface 112 may include the downwardly facing surface 114 (e.g., a soffit) of horizontal component 104, the outwardly facing surface 116 of vertical component 102, bevel 212, and/or any portion or combinations of the aforementioned items.

In some embodiments of the present invention such as that shown in FIG. 2, the upper corner of a distal end of horizontal component 104 is in the form of rounded edge 214. However, alternate configurations and/or shapes for this edge may be substituted including, without limitation a squared edge, a chamfered edge or edge treatment. Or edge 214 may be omitted, without departing from the scope hereof.

Additionally, in some embodiments of the present invention such as that shown in FIG. 2, bevel 212 extends longitudinally along the intersection of outwardly facing surface 116 of vertical component 102 and downwardly facing surface 114 of horizontal component 104. Bevel 212 acts as a drip edge to cause water to drip downward rather than along downwardly facing surface 114. Bevel 212 is located at an angle of forty-five degrees (45°) relative to outwardly facing surface 116 of vertical component 102 and downwardly facing surface 114 of horizontal component 104. However, alternate configurations and/or shapes for this bevel may be substituted, or bevel 212 may be omitted, without departing from the scope hereof.

Additionally, in some embodiments of the present invention such as that shown in FIG. 2, protrusion 216 extends longitudinally from and below downwardly facing surface 114 of horizontal component 104 directly below joining component 234. Protrusion 216 has a semicircular cross-section, and it acts as a drip strip to cause water to drip downward rather than along downwardly facing surface 114. Protrusion 216 and bevel 212 both act to eliminate or minimize the amount of water that reaches structural support 302 in an effort to minimize corrosion thereof. However, alternate configurations, locations, and/or shapes for this protrusion may be substituted, or protrusion 216 may be omitted, without departing from the scope hereof including, without limitation, a longitudinal recess. For example, protrusion 216 may be located at the approximate midpoint of a proximal half of said substantially horizontal component.

Form 100 may be formed of many different types of materials or combinations thereof, provided that the strength of the material, or combination of materials, is sufficient to hold the implied loads such as that of the uncured concrete. In the depicted embodiment, form 100 is made from 5,000 PSI fiber-reinforced concrete, however, other materials, or combinations of materials, including, but not limited to, polymers and/or high strength concretes may be substituted.

Optionally, form 100 may include an interior reinforcement 242. In the depicted embodiment, interior reinforcement 242 is a four-by-four (4"×4") epoxy-coated, welded wire mesh that extends substantially throughout the height of vertical component 102 and the width of horizontal component 104 with the exception of a bend at the intersection thereof. The portion of the depicted interior reinforcement 242 located within vertical component 102 is located approximately equidistant from inwardly facing surface 110 and outwardly facing surface 116. The portion of the depicted interior reinforcement 242 located within horizontal component 104 is located approximately equidistant from upwardly facing surface 108 and downwardly facing surface 114. These two portions are connected to each other via a curve in the interior reinforcement, such curve having a radius of approximately four inches (4"). However, alternate locations and configurations may be substituted including, without limitation, reinforcements made of carbon mesh or other materials having tensile strength and reinforcements having partially exposed portions (portions that extend beyond the confines of form 100). Or interior reinforcement 242 may be omitted without departing from the scope hereof.

Form 100 may optionally include a rabbet such as rabbet 218 to assist in placement of form 100 atop a structural member 302 (e.g., a girder, stringer, etc.) as discussed in greater detail below. In the depicted embodiment, rabbet 218 extends longitudinally along the distal lower corner of horizontal component 104 and it is substantially L-shaped. That is, when form 100 is viewed in its upright position, rabbet 218 is in the form of an L that has been inverted and rotated 90 degrees counterclockwise. However, alternate shapes may be substituted without departing from the scope hereof. Further, although structural member 302 is depicted in the shape of a traditional bridge girder, structural member may have virtually any shape or configuration and form 100 and/or rabbet 218 may be modified accordingly, as needed.

As best seen in FIG. 2, form 100 includes a plurality of inserts 202. In the depicted embodiment, inserts 202 are threaded, plastic inserts such as the precast concrete plastic inserts manufactured by A.C. Miller Concrete Products, Inc. and having model no. IN-025 through IN-150. However, alternate inserts may be substituted including, but not limited to, galvanized steel inserts and non-threaded inserts. Or, apertures passing completely through horizontal and/or vertical components 102 and 104, respectively, may be substituted. In the depicted embodiment, inserts 202 are embedded in form 100 during manufacturing thereof (e.g., during the casting of the form via a concrete mold), however, alternate embodiments are envisioned in which such inserts are installed after casting and/or placement of form 100 as discussed in greater detail below. Additionally, although form 100 includes seven (7) inserts 202, varying quantities may be substituted. For example, in one alternate embodiment, a plurality of inserts are provided in the form of a grid to allow multiple exterior reinforcement style form attachments 206 to be installed (as discussed below) to increase the coupling between form 100 and any adjacent cast-in-place concrete structures or structure portions.

In the depicted embodiment, inserts 202 are compatible with a variety of form attachments 206. Form attachments 206 may perform any one of a number of functions including, without limitation, assisting with installation of form 100, increasing the strength of the interface between form 100 and the cured concrete, and the like. Form attachments 206 may be any one of a plurality of commercially available connection devices. For example, in the depicted embodiment, form attachments 206*a* and 206*b* are one-half inch (½") threaded shank eye bolts with a shoulder as manufactured by Chicago Hardware, and form attachments 206*c* and 206*d* are exterior reinforcements. In the depicted embodiment, this exterior reinforcement is a reinforcement bar of Grade 60 (i.e., 60,000 PSI) such as an imperial size #4, one half inch (½") diameter reinforcement bar that includes threads on its proximal end (e.g., these threads may be added during manufacturing or during construction of the structure) and a J-shaped hook on its distal end. However, alternate exterior reinforcements may be substituted without departing from the scope hereof. Form attachments 206 connect to form 100 by simply threading of same into a compatible insert such as insert 202 as discussed above.

Form attachments 206*a* and 206*b* facilitate attachment of a tie or the like during installation of form 100 and prior to the pouring of concrete as discussed in greater detail below. That is, the tie may be threaded through the eye of form attachments 206*a* and 206*b* prior to the tying thereof. In the depicted embodiment, form attachments 206*a* are threaded into inserts 202*a*, and form attachments 206*b* are threaded into inserts 202*c* as depicted in FIG. 2.

Additionally, a form attachment 206*a* or 206*b* may be threaded into insert 202*d* to facilitate coupling of form 100 to a lifting cable 310 via a coupler 309 or the like prior to placement of same as discussed below. That is, coupler 309 or the like may be inserted through a form attachment 206 and/or a shackle coupled thereto to lift facilitate the lifting of form 100 from a stack of forms and/or from a form holder such as form holder 404 as described below with respect to FIGS. 4A and 4B. In the depicted embodiment, such an attachment is threaded into insert 202*d*, which is located at the center of gravity of form 100. This location minimizes movement of the form during lifting and placement, however, alternate locations may be substituted without departing from the scope hereof. After the form is set in place and detached from lifting equipment 402, form attachment 206*a* may be removed from insert 202*d* to allow the threading of a different form attachment thereto including, without limitation, form attachments 206*a*, 206*b*, 206*c*, and/or 206*d* as discussed above.

Form attachments 206*c* and 206*d* increase the bond between form 100 and the concrete poured adjacent thereto. That is, after the concrete is poured, exterior reinforcement-style form attachments 206*c* and 206*d* are encased therein and form a stronger, more permanent bond between form 100 and the poured concrete after curing of the latter. However, alternate form attachments 206, or varying quantities thereof, may be omitted or substituted without departing from the scope hereof. For example, form attachments 206 may include alternate hardware capable of coupling to, without limitation, S-hooks, shackles, coil rod ties, coil loop inserts, turnbuckles, washers and nuts, welded studs or hooked brackets and the like, some or all of which is capable of purposes including, but not limited to, attaching to existing or proposed steel, wood, or concrete structural members and facilitating the attachment of inboard formwork.

In one aspect of the depicted embodiment, interconnection clip 204 is optionally mounted on upwardly facing surface 118 of the vertical components 102 of adjacent forms 100. In the depicted embodiment, each approximate half of clip 204 is mounted atop upwardly facing surface 118 of the vertical components of two adjacent forms 100 as best seen in the side view of FIG. 2. This coupling of two forms 100 via clip 204 allows clip 204 to: distribute the load of each form 100 to its adjacent forms 100, if any; maintain alignment of forms 100; and/or provide a mounting surface for a railing or railing system.

As best seen in FIG. 2, this exemplary interconnection clip 204 includes top wall 224, inner wall 226, and outer wall 228. Top wall 224 mirrors the configuration of upwardly facing surface 222 of vertical component 102. That is, top wall 224 inclines upwardly and inwardly toward inner wall 226 at an angle of approximately thirty degrees (30°). Inner and outer walls 226 and 228, respectively, extend downward from the longitudinal edges of top wall 224 and extend throughout the full length of clip 204. The bottom edges of inner and outer walls 226 and 228, respectively, are located at the same height, thereby causing inner wall 226 to be taller than outer wall 228 due to the angled nature of top wall 224. However, alternate configurations of clip 204 may be substituted without departing from the scope hereof or clip 204 may be omitted entirely.

Interconnection clip 204 may optionally include railing support 220. In the depicted embodiment, railing support 220 includes a cylindrical portion 230 suspended above top wall 224 by vertical railing support component 232. Vertical railing support component 232 is approximately the same diameter as the railing to be threaded therethrough and has an inside diameter of approximately one and five-eighth inches (1⅝"), and is located along the approximate longitudinal centerline of top wall 224. In the depicted embodiment, clip 204 only extends approximately one-tenth the length of form 100, however, other distances may be substituted including, without limitation, a distance equal to the full length of form 100. Cylindrical portion 230 sits atop vertical railing support component 232 and is approximately centered thereupon. It extends the full length of top wall 222. However, alternate configurations and/or locations may be substituted without departing from the scope hereof.

After installation of form 100, a railing (e.g., a cable, pipe, etc.) may be installed through railing support 220 to extend partially or throughout the length of the bridge or other structure in accordance with OSHA guidelines (to prevent or minimize falls during construction of the structure) or for other purposes. That is, in one embodiment of the present invention, the height of form 100 is sufficient to eliminate the need for a railing as per OSHA requirements. However, once the deck 318 is poured, the height between the top of form 100 and deck 318 may become less than the minimum required by OSHA. In such a scenario, a railing may be added to meet OSHA requirements. However, alternate configurations of railing support 220 may be substituted without departing from the scope hereof or support 220 may be omitted entirely. Railing support 220 may also be eliminated without departing from the scope hereof. In one such embodiment, the height of form 100 is increased to allow the panel to exceed the railing height required by OSHA, thereby eliminating the need for a railing.

Referring now to FIGS. 3A through 3I, depicted are progressive side, perspective, and section views of a structure created via one process for installing form 100 on a structural member 302 in accordance with one embodiment of the present invention. In the depicted example, structural member 302 is a bridge fascia girder installed as known in the art. Prior to placement of form 100 on structural member 302, structural member attachment 304 is—mounted on the structural member via welding, J-hook bracket, or the like to facilitate the installation of ties that hold form 100 in place prior to the pouring of the concrete deck. In the depicted embodiment, structural member attachment 304 is a welded stud such as a High Strength, CPL Stud as manufactured by Nelson Stud Welding and having part no. 101021688.

Figure 3A:
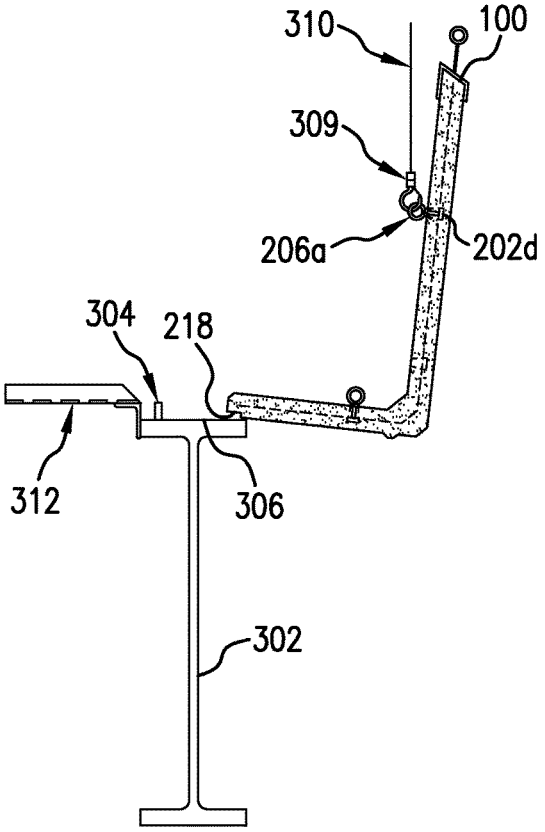
FIGS. 3A through 3I depict progressive side, perspective, and section views of a structure created via one process for creating a concrete structure utilizing the fascia form shown in FIGS. 1A, 1B, and 2 in accordance with one embodiment of the present invention.

In the depicted exemplary form 100, structural member attachment 304 is mounted approximately one and one half inches (1½") from the inner edge of upwardly facing surface 306 of structural member 302, however, alternate locations may be substituted. Structural member attachments 304 are located such that approximately two (2) structural member attachments 304 are utilized for installation of each form 100 as best seen in FIG. 3B, however, varying quantities may be substituted.

Also, alternate structural member attachments may be substituted without departing from the scope hereof. For example, structural member attachments may be type B4L standoff support studs, type R9L rope hook studs, Type R6P rectangular slotted studs, type SBL shoulder studs, type TBL internally threaded studs, all as manufactured by Nelson Stud Welding. Or, alternatively, structural member attachments may be designed to hook onto the side of structural member 302, thereby eliminating the need for welding thereof. One such structural member attachment is the Century Series Hanger having model no. C130 as manufactured by Dayton Superior.

In yet another alternate embodiment, a formwork attachment may be substituted for, or used in addition to, the structural member attachment. One such formwork attachment is a galvanized hook that hooks into a slot that is cut into formwork such as formwork 312. Other formwork attachments may include, but are not limited to, Hook Bolts having model no. D1-J, DILA, or D1L, coil loop straight inserts having model no. B16, Inside Tie Rods having model nos. D1 and D18, and/or a heavy duty screed support having model no. G15, all as manufactured by Dayton Superior.

Figure 3C:
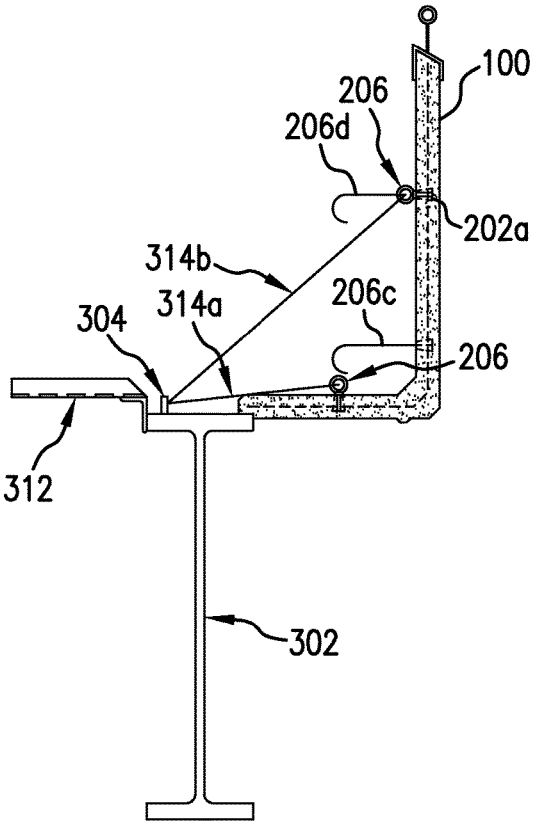
Figure 3B:
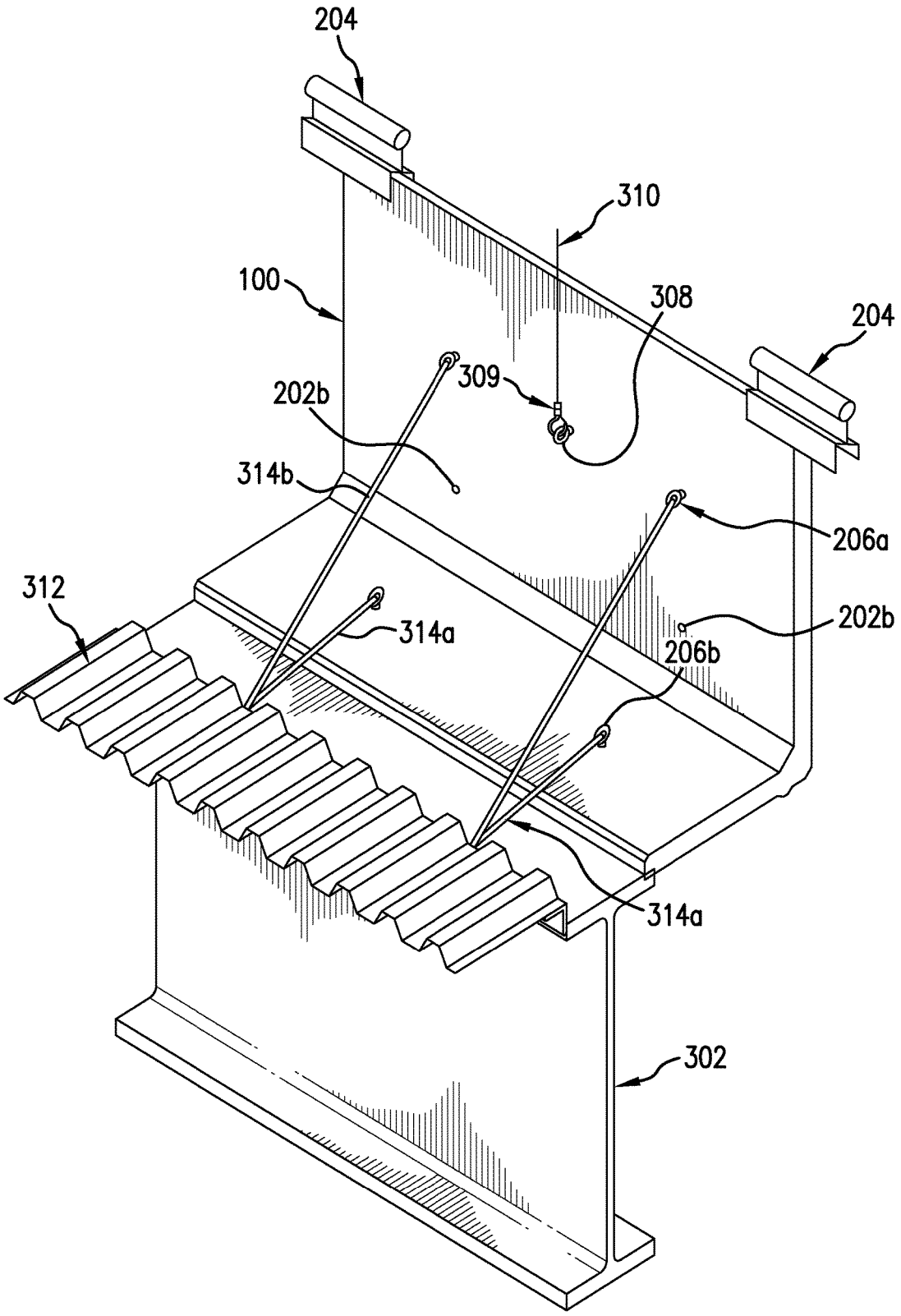

After structural member attachments 304 are in place (as best seen in FIG. 3C), form 100 may be lifted via any capable lifting equipment (e.g., a crane, davit, etc.) such as that equipped with a lifting cable 310 or the like for placement atop structural member 302. One such method is described below with respect to FIG. 4B. Lifting cable 310 and an associated coupler 309 or the like may attach to form 100 via a direct or indirect attachment to form attachment 206*a*. For example, intermediate coupling devices such as a shackle or the like may couple coupler 309 to form attachment 206*a*.

FIG. 3A depicts a side view of form 100 after it is lowered atop structural member 302 such that rabbet 218 aligns with the upper and outer edge of structural member 302. For the purposes of FIG. 3A, 202*a* located to the right of 202*d* (as best seen in FIG. 1B) has been removed to show one method of connecting lifting equipment 402 to insert 202*d*. Form 100 is then rotated by lifting equipment 402 until vertical component 102 is substantially plumb (i.e., substantially perpendicular to upwardly facing surface 306 of structural member 302) as best seen in the side view of FIG. 3C.

Thereafter, form 100 is tied in place utilizing form attachments 206*a*, 206*b*, structural member attachments 304, and one or more tie(s) 314 as described below in order to secure form 100 to structural member 302. FIG. 3B depicts form 100 after it has been tied in place. It should be noted that, in the depicted embodiment, tie(s) 314*b* are the primary support element (i.e., the primary mechanism utilized to hold the form in place prior to the pouring of the concrete) and tie(s) 314*a* are safety elements that prevent or minimize form 100 from being accidentally dislodged from structural support 302. Moreover, tie(s) 314*a* are installed in a substantially horizontal member as compared to tie(s) 314*b*, which are installed at an angle. End fittings for each of these ties may also be selected as needed. For example, tie(s) 314*a* may include adjusting nuts on one or more ends, whereas tie(s) 314*b* may include one or more turnbuckle-style end fittings. However, any end fitting may be substituted, or omitted, without departing from the scope of the present invention.

Tie(s) 314 may be Inside Tie Rods as manufactured by Dayton Superior and having model no. D1 or D18. Tie rods may include various end fittings on one or both ends including, without limitation, turn buckle fittings. However, no such fittings are required to implement the present invention. Also, alternate structural member attachments and/or ties including, without limitation, Richmond tie rod units may be substituted without departing from the scope hereof.

Figure 3D:
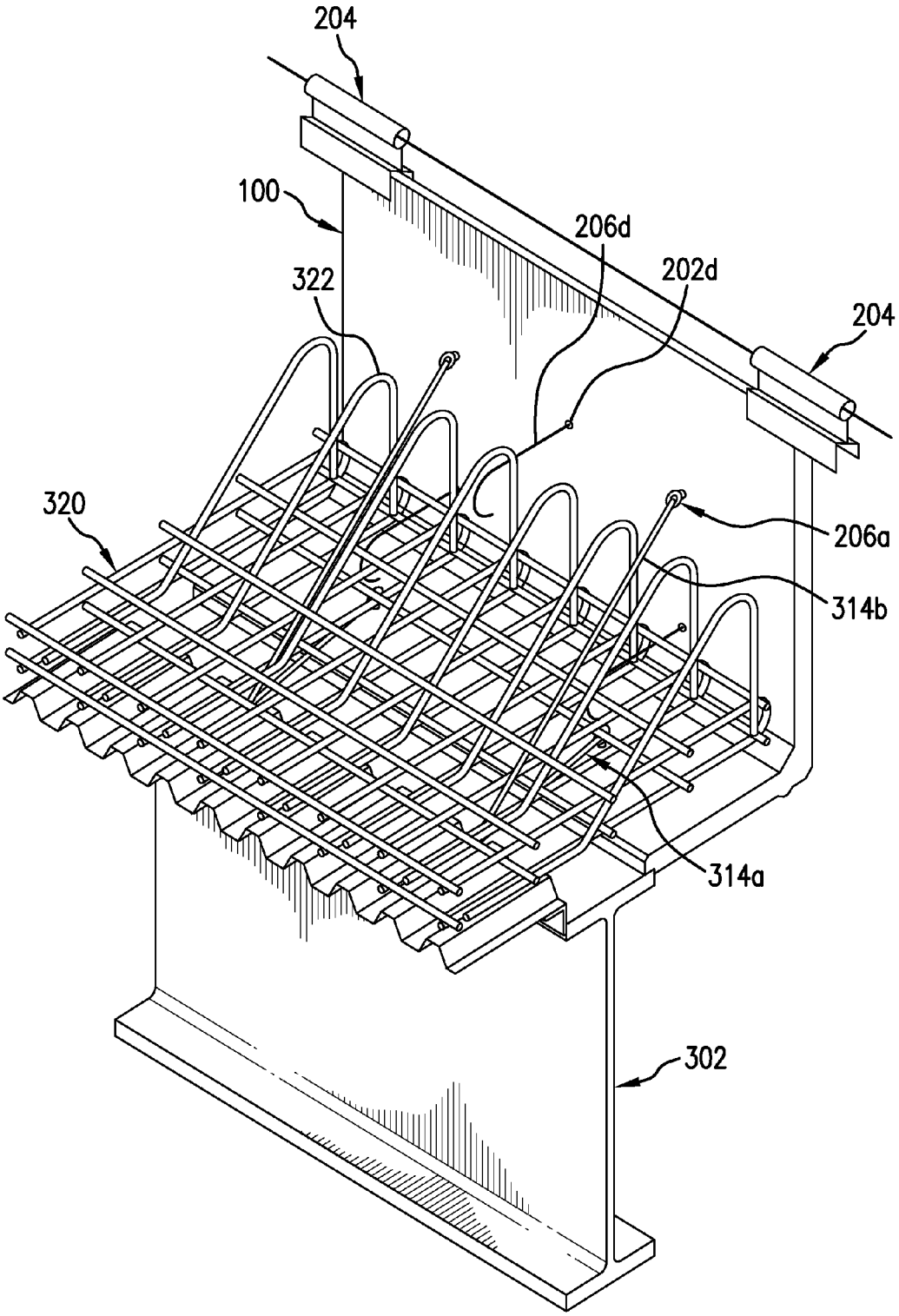
Figure 3E:
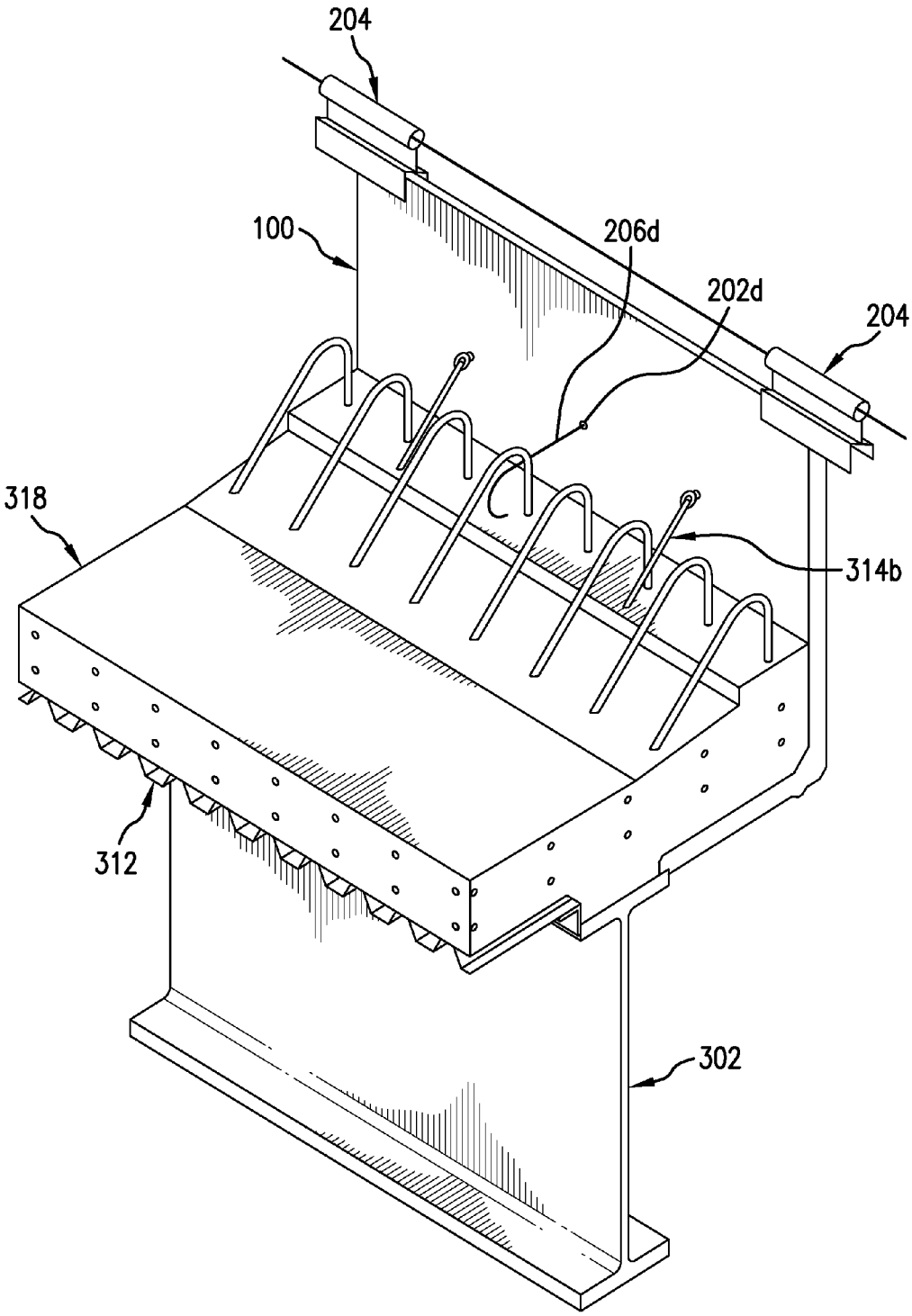

Form 100 may be disconnected from lifting equipment 402 as soon as it is secured in place, and any form attachments required for connection of form 100 to lifting equipment 402 may be removed, reused, or left in place/unused. Any other desired form attachments including, without limitation, exterior reinforcements or the like may be installed. For example, form attachments 206*c* and/or 206*d* may be installed in inserts 202*b* and/or 202*d* to further increase the bond between the cured concrete and form 100 as described in greater detail above. FIG. 3C depicts such exterior reinforcements after installation. Then, railing 316 may be threaded through railing supports 220. FIGS. 3D, 3E, and 3G depict railing 316 after installation. It should be noted that form attachment(s) such as form attachments 206*c* and 206*d* may be installed at an alternate point in the process so long as they are installed prior to the pouring of deck 318. Also, railing 316 may be installed at any point in the installation process.

FIG. 3B depicts a perspective view of form 100 mounted and tied atop structural member 302. FIGS. 3B and 3C also depict deck formwork 312, which is installed on the opposing side of structural member 302 utilizing methods known in the art. Although it is anticipated that formwork 312 is installed prior to placement of form 100 atop structural member 302, embodiments of the present invention are also envisioned in which form 100 is installed prior to formwork 312. It should also be noted that although formwork 312 is shown as an unfilled stay in place form, filled stay in place forms are also compatible with the systems and methods of the present invention. Such forms may be filled with fillers that include, but are not limited to, foam and concrete.

After form 100 is tied in place, it contains the work area as soon as it is installed as discussed in greater detail below, which minimizes or eliminates fall hazards, thereby eliminating the time, costs (e.g., labor costs, removal costs, disposal costs, etc.), and downtime associated with installation of safety measures that are typically required (e.g., formwork, scaffolding, road closure, etc.) to contain the work area. That is, minimal or zero excess materials are needed to contain the work area since the form performs this task while also remaining in place after construction to become part of the structure being built. Also, the disruption of traffic or other environmental considerations beneath the structure being built is minimized as all work can be safely performed from atop the structure.

FIG. 3D depicts a perspective view of form 100 mounted and tied atop structural member 302 as well as deck formwork 312, deck rebar 320, and primary barrier rebar 322 after it is installed on the opposing side of structural member 302, structural member 302, and upwardly facing surface 108 of horizontal component 104. Deck rebar 320 and primary barrier rebar 322 are installed as is also known in the art.

Referring now to FIG. 3E, depicted is a perspective view of form 100, structural member 302, and formwork 312 after the concrete has been poured to form deck 318. Deck 318 is formed upon the curing of the concrete.

Figure 3F:
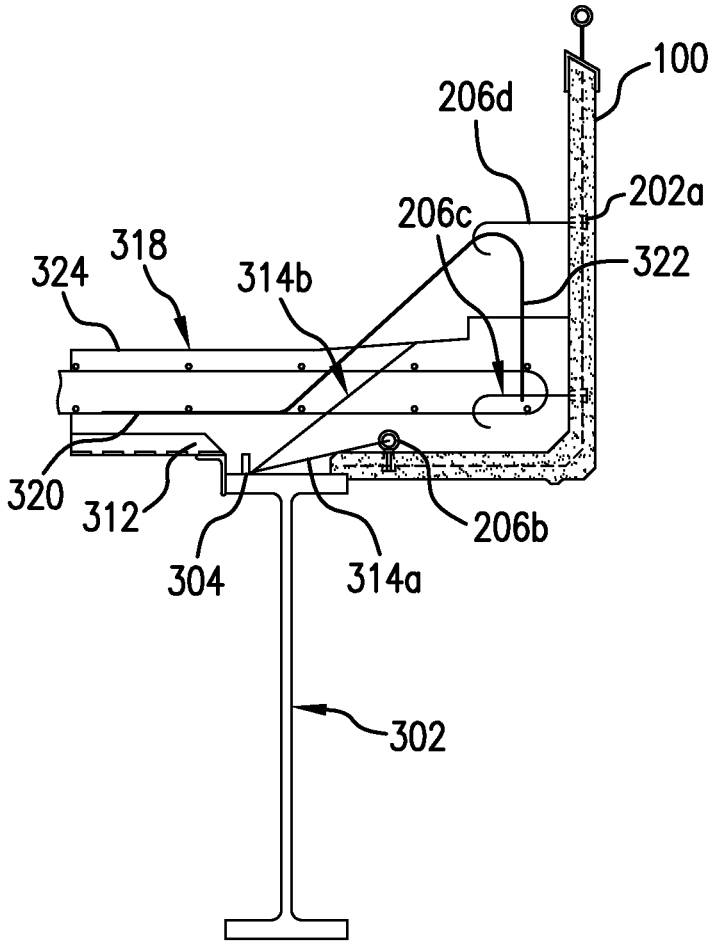
Figure 3G:
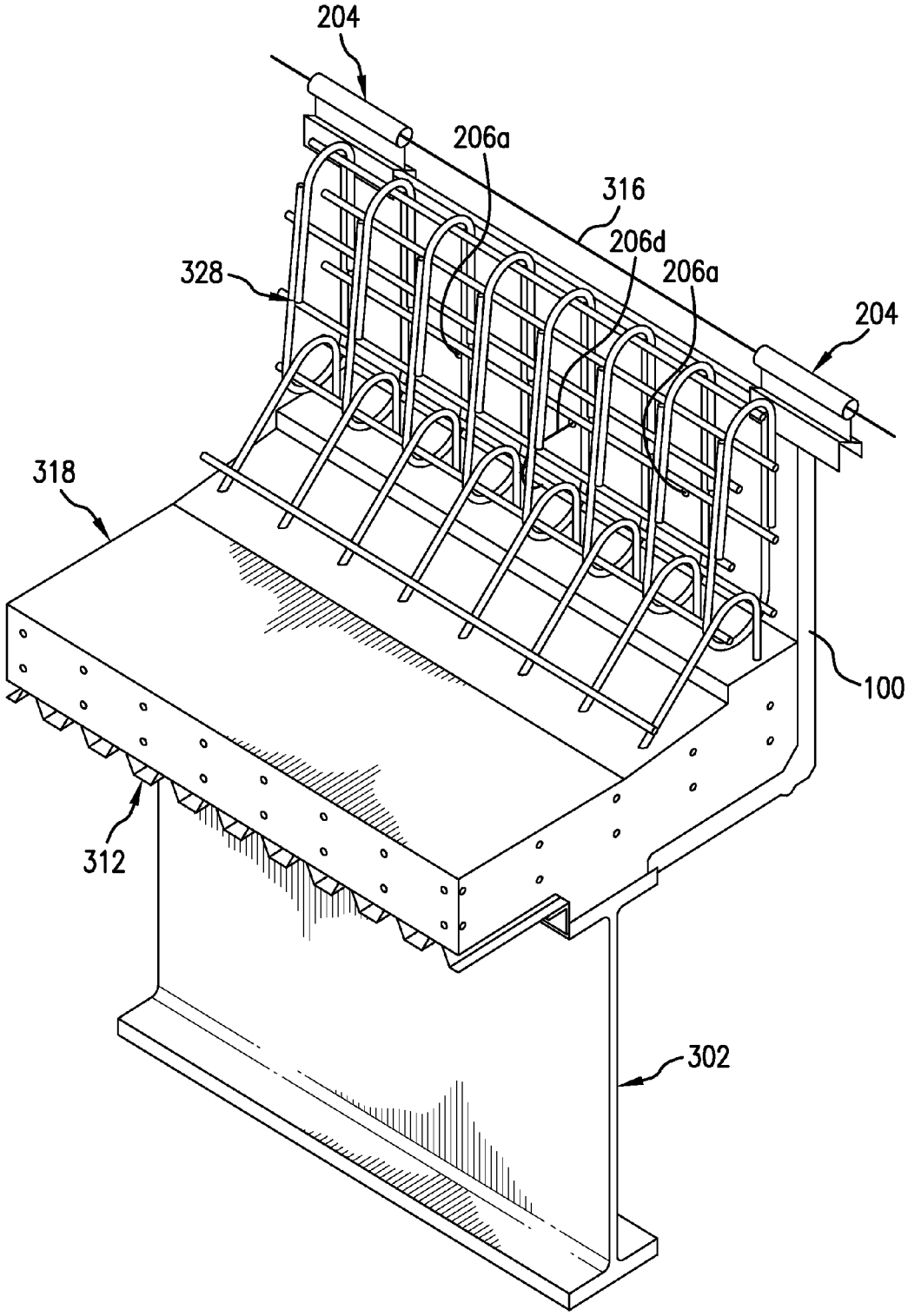

After the concrete is poured and cured, the portion of ties 314*b* extending above deck 318 may optionally be removed from form attachments 206*a* as depicted in the side view of FIG. 3F. However, form attachments 206*b* and 206*c* remain after curing of the concrete as they are encased therein.

Figure 3H:
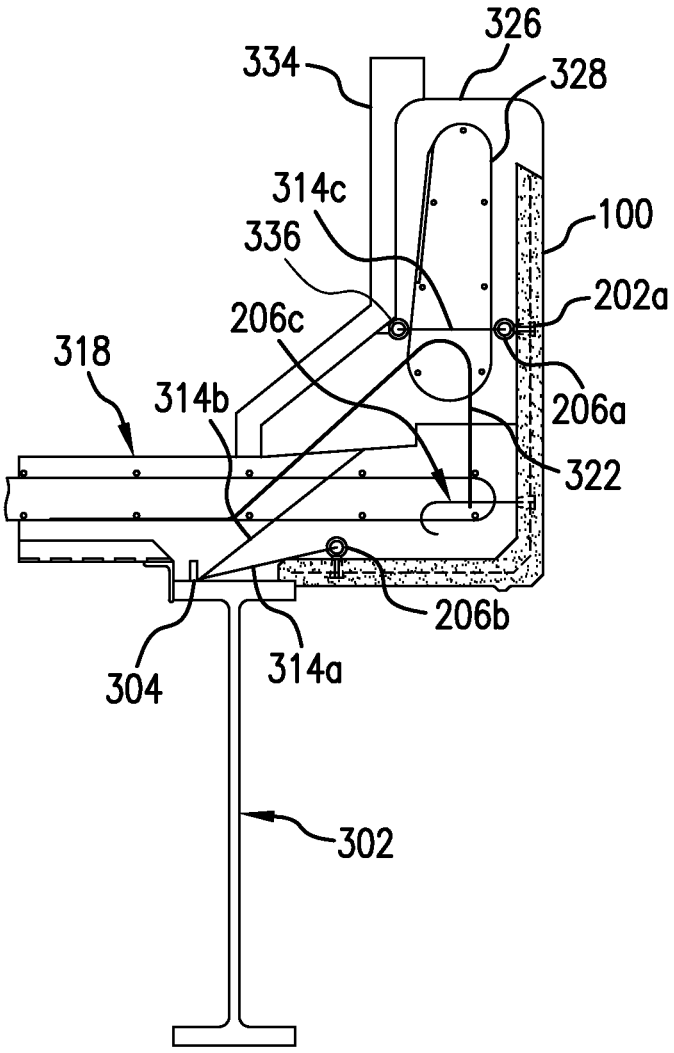

The encasing of exterior reinforcement style form attachments 206*c* in the concrete deck 318 (and form attachment 206*d* in barrier 326) further couples form 100 to concrete deck 318 and barrier 326, and facilitates the ability of form 100 to accommodate the shear and moment forces placed thereupon by the weight of the concrete deck 318. As discussed above, the portion of tie(s) 314*b* that extend above upwardly facing surface 324 of concrete deck 318 may optionally be removed after curing of the deck concrete. Alternatively, it may be left in place and encased in barrier 326 (See FIG. 3I). If a portion of tie(s) 314*b* are removed, form attachments 206*a* may also optionally be removed and/or replaced with new form attachments including, but not limited to, exterior reinforcement style form attachments such as form attachments 206*c* and 206*d* to increase the coupling of form 100 to the barrier to be mounted adjacent thereto as discussed below. Or, as is shown in the depicted embodiment, form attachments 206*a* are left in place and utilized to install substantially horizontal tie(s) 314*c* (as best seen in FIG. 3H). Ties 314(*c*) couple form 100 to inboard formwork 334 (i.e., the formwork utilized to pour barrier 326) prior to the pouring of the concrete for barrier 326 in an effort to further support the formwork and create a greater bond between form 100 and barrier 326 after curing of same. Tie(s) 314*c* also assist with resisting the pressure applied to formwork 334 and form 100 by the wet concrete poured to form barrier 326. Also, form attachments 206*a* may also be replaced with a differing attachment capable of coupling ties 314*c* to form 100 without departing from the scope hereof.

FIG. 3F depicts a side view of form 100, structural member 302, exterior reinforcement 206*c*, and formwork 312 after the concrete has been poured to form deck 318 including dashed lines to indicate the components encased therein, namely, deck rebar 320, primary barrier rebar 322, lower form attachment 206*b*, girder attachment 304, tie(s) 314*a*, a portion of tie(s) 314*b*, and exterior reinforcement 206*c*. As illustrated, primary barrier rebar 322 extends above upwardly facing surface 324 thereof.

FIG. 3G depicts a perspective view of deck 318 after curing of the concrete including structural member 302, formwork 312, primary barrier rebar 322, form 100, exterior reinforcement 206*d*, and secondary barrier rebar 328. Secondary barrier rebar 328 is installed within and above primary barrier rebar 322 as illustrated in FIG. 3G and as is known in the art.

Finally, inboard barrier formwork 334 is put in place, ties 314*c* are installed to secure formwork 334 to form 100, and the railing system installed for safety purposes (i.e. clips 204 and railing 316) is removed in preparation for the pouring of the barrier concrete. The railing system may be removed before or after installation of the inboard barrier formwork 334. Ties 314*c* are coupled to formwork attachment 336, which may be identical to, or similar to, form attachment 206*a*, however, such attachment 336 is coupled to formwork 334 either prior to, or after, such formwork is set in place. Then, the concrete for barrier 326 is cast in place.

Figure 3I:
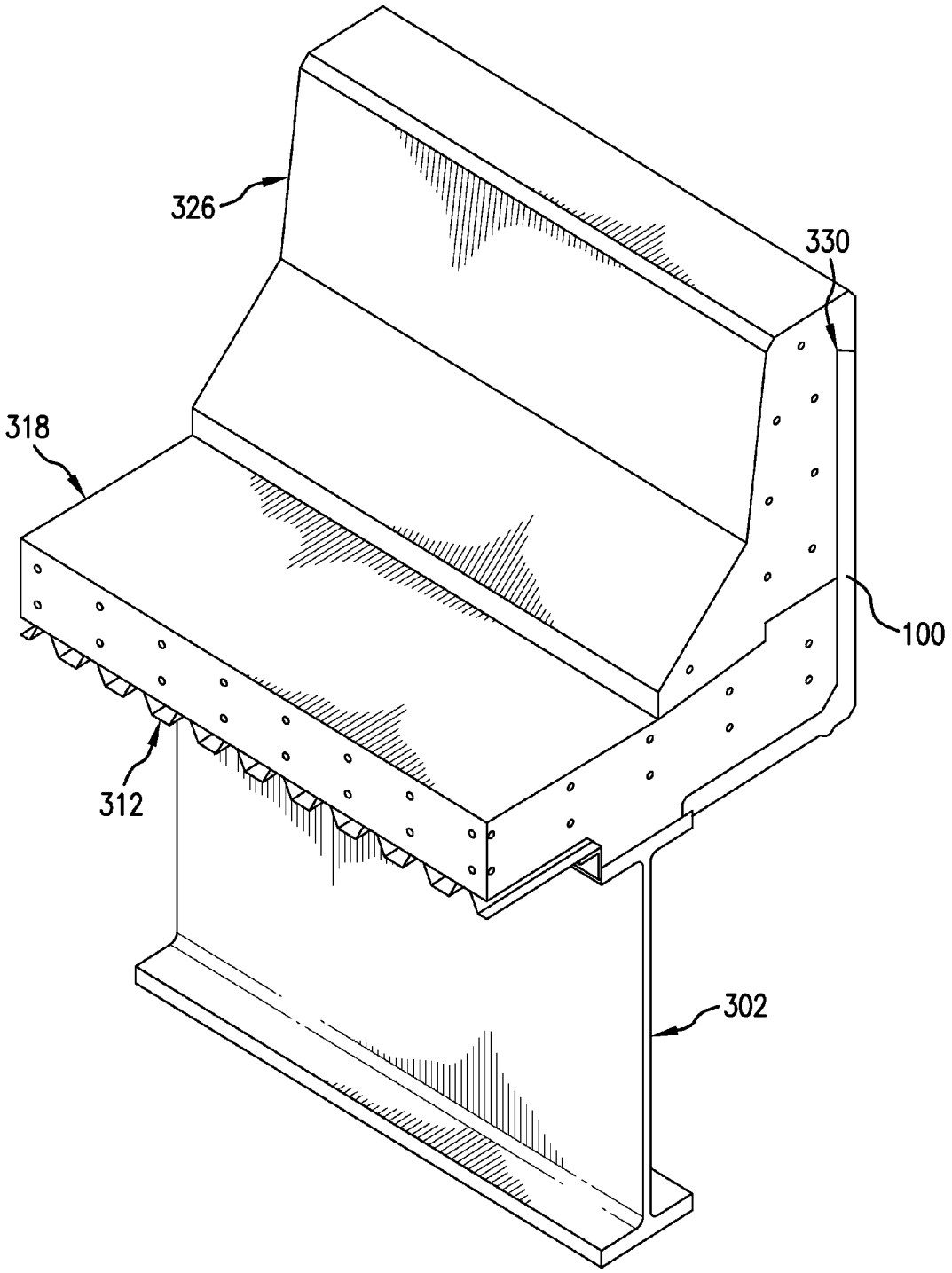

FIGS. 3H and 3I depict side and perspective views of form 100, structural member 302, tie(s) 314*c*, deck 318, barrier 326, and formwork 312 after the concrete has been poured to form barrier 326. FIG. 3H also depicts the components encased therein, namely, deck rebar 320, primary barrier rebar 322, secondary barrier rebar 328, lower form attachment 206*b*, structural member attachment 304, tie(s) 314*a*, a portion of tie(s) 314*b*, tie(s) 314*c* and exterior reinforcements 206*c* and 206*d*. The pouring of barrier 326 above upwardly facing surface 222 forms construction joint 330 between upwardly facing surface 222 and barrier 326.

Now referring to FIG. 4, embodiments of the present invention also generally relate to apparatus, systems, and methods for storing, transporting and/or installing fascia forms. Although the described use of such apparatus, systems, and methods is new bridge construction, the use thereof is not limited thereto.

As depicted in FIG. 4, system 400 includes, inter alia, lifting equipment 402, form holder 404, and work bridge 406. System 400 facilitates the erection/installation of a form such as, but not limited to, form 100 as discussed above. Form holder 404 is designed to support a plurality of forms in a stacked manner during storage, transportation, and installation. In the depicted embodiment, frame holder 404 is made of steel but alternate materials may be substituted including, without limitation, aluminum, other alloys, and combinations of the foregoing materials. Materials may be selected in order to minimize weight, but this is not required to implement the systems and methods of the present invention.

Figure 4A:
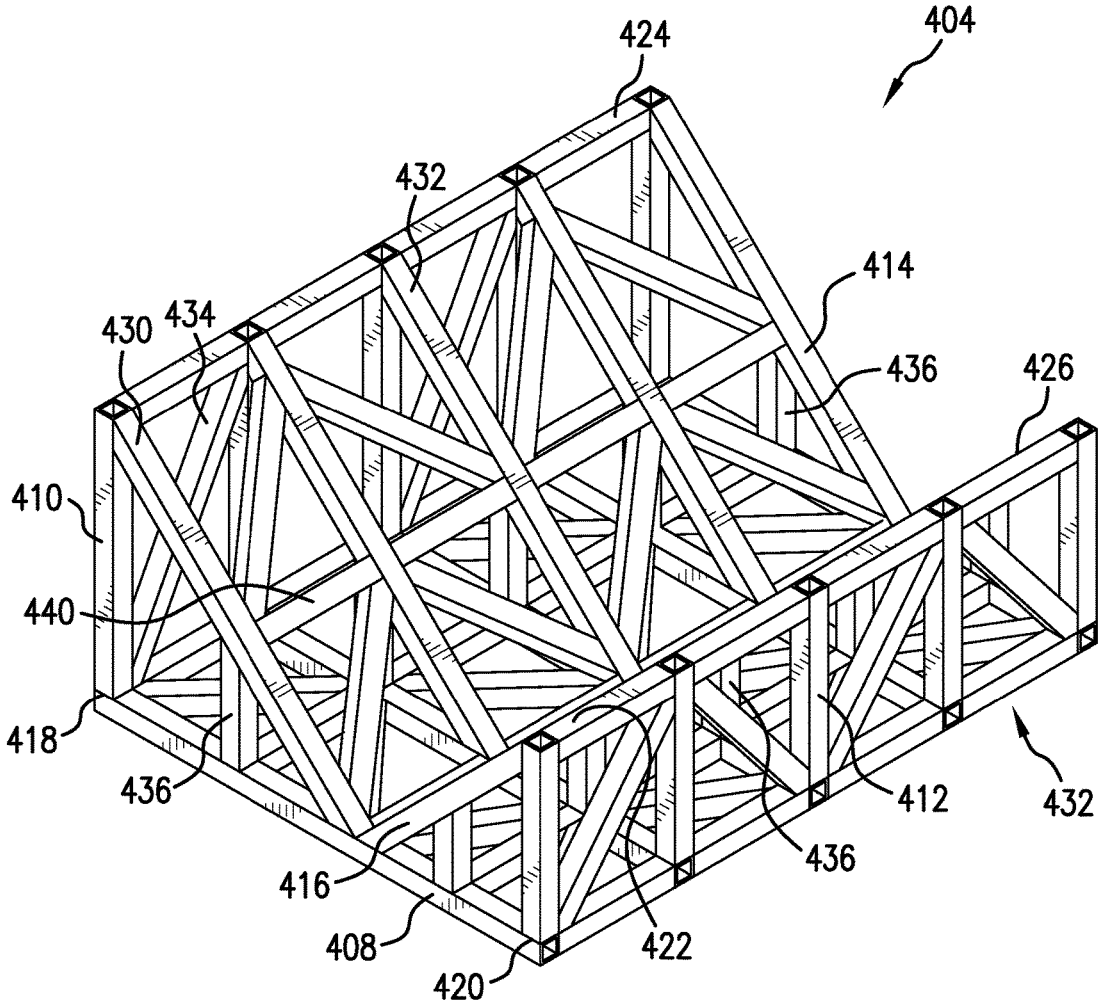
FIG. 4A depicts a perspective view of a form holder in accordance with one embodiment of the present invention.
Figure 4B:
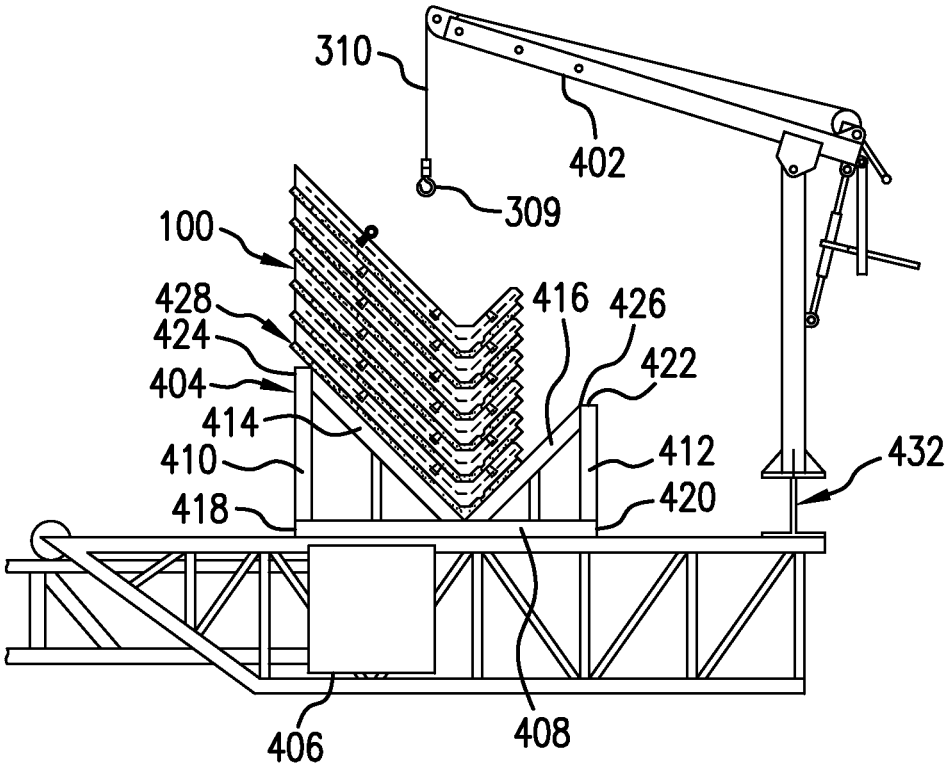
FIG. 4B depicts erection equipment for installing a plurality of forms stacked atop the form holder of FIG. 4A in accordance with one embodiment of the present invention.

As best seen in FIG. 4A, form holder 404 includes base section 408, rear section 410, front section 412, rear intermediate section 414, and front intermediate section 416, all of which are substantially rectangular. In the depicted embodiment, base section 408 and all of the aforementioned sections have lengths approximately equivalent to the forms to be supported by the form holder. However, varying lengths may be substituted without departing from the scope hereof.

More specifically, form holder 404 includes a substantially rectangular, substantially horizontal base section 408. A substantially rectangular rear section 410 extends vertically from a first longitudinal side 418 of base 408, and a substantially rectangular front section 412 extends vertically from a second longitudinal side 420 of base 408. A substantially rectangular front intermediate section 416 extends at an angle of approximately forty five degrees from a first upper longitudinal end 422 of said front section to base 408, and a substantially rectangular rear intermediate section 414 extends at an angle of approximately forty five degrees from a second upper longitudinal end 424 of said rear section to base 408. Rear intermediate section 414 intersects front intermediate section 416 at an angle of approximately ninety degrees.

Additionally, in the depicted embodiment, rear intermediate section 414 has a height approximately equal to a height of form 402 minus the width of rear section 410. The height of front intermediate section 416 is then selected to be the height that allows front intermediate section 416 to be located substantially perpendicular to rear intermediate section 414 without extending beyond front section 412. Similarly, the height of front section 412 is selected to be equivalent to topmost edge 426 of front intermediate section 416. However, varying dimensions may be substituted without departing from the scope hereof.

In the depicted embodiment of the present invention, each of the base section 408, rear section 410, front section 412, rear intermediate section 414, and front intermediate section 416 are substantially rectangular and are not solid. Rather, these sections are comprised of a plurality of subframe support members 430 arranged to form substantially rectangular and/or square subframes 432 for each section. Many of these subframes 432 include angled support members 434 as depicted in FIG. 4A. Such support members are provided to increase the strength of the corresponding section.

As also shown in FIG. 4A, a plurality of vertical section supports 436 may be added to support rear intermediate section 414 and/or front intermediate section 416 as necessary to increase the load bearing capabilities of form holder 404.

The above described configuration of form holder 404 allows a plurality of forms such as forms 100 to be stacked atop form holder 404 via lifting equipment such as lifting equipment 402 as described herein. In the depicted embodiment, spacers 428 are placed at predetermined intervals between form holder 404 and the bottommost form, and also between individual forms. In the depicted embodiment, spacers 428 are furring strips having a width of approximately one inch (1"), however, alternate spacers may be substituted without departing from the scope hereof. Form holder 404 may also be used as a shipping pallet during transportation/shipping of one or more forms.

Also, embodiments of the present invention are envisioned in which one or more layers of one or more sheets of plywood is placed atop the upwardly facing surface 440 of rear intermediate section 414 and/or front intermediate section 416 to cover all or at least a portion thereof. Form 100 may be placed directly atop the plywood, or spacers 428 may be incorporated between the plywood and form 100 without departing from the scope hereof.

Forms 100 are stacked in a position in which they are rotated backwards at an angle of approximately forty five degrees. Form holder 404 of the depicted embodiment is capable of supporting approximately nine thousand (9,000) pounds, however, alternate load capabilities may be substituted without departing from the scope hereof.

As shown in FIG. 4, in the depicted embodiment, forms 100 and form holder 404 may be supported by workbridge 404 prior to installation. For example, workbridge 404 may be a Terex Bidwell thirty foot (30') by thirty four (34') foot heavy duty work bridge installed as in known in the art. The workbridge is lightweight and works within the spacing of the screed rails that are typically installed by the contractor that screeds the finished concrete. Forms and/or form holders with stacked forms may be located on one or both ends of workbridge 404 while still allowing a sufficient span between structural members to facilitate installation of forms as described herein. However, other workbridges or equipment performing a similar function may be substituted without departing from the scope hereof. The depicted embodiment of the present invention envisions a manually powered workbridge, however, workbridges having varying types of control may be substituted including, without limitation, hydraulic, motor-driven, and mechanically driven lifting equipment. In scenarios in which a hydraulic drive is used on the workbridge, the same operating engineer might control both the hydraulic drive system and hydraulically controlled lifting equipment.

In the depicted embodiment, lifting equipment 402 is a crane. For example, lifting equipment may be a manually controlled davit crane as manufactured by Dayton and having model no. 7CZ12. However, lifting equipment having varying types of control may be substituted including, without limitation, hydraulic, motor-driven, and mechanically driven lifting equipment. In scenarios in which a hydraulic drive is used on the workbridge, the same operating engineer might control both the hydraulic drive system and the hydraulically controlled davit.

Lifting equipment 402 may rest directly atop, for example, the screed or other equipment used for leveling the concrete. This equipment including, without limitation, wheels and rails is installed as in known in the art for the purpose of leveling the concrete. In some embodiments of the present invention, a support 432 such as a beam or the like may be utilized to further support and/or raise the height of lifting equipment 402.

In the depicted embodiment, lifting equipment 402 is equipped with a cable 310 and associated coupler 309 or the like capable of lifting individual forms via a form attachment 206*a* and a coupler 309 located at the approximate center of gravity of form 100. One such form attachment is a one-half inch (½") threaded shank eye bolt with a shoulder as manufactured by Chicago Hardware. Coupler 309 is passed through form attachment 206*a*. A shackle or the like may also be utilized to more securely attach coupler 309 to form attachment 206*a*. Thereafter, form 100 may be lifted from the stack of forms and/or form holder 404 and suspended over the side of the bridge relative to structural member 302 as shown in FIGS. 3A and 3B as discussed above. Form 100 may then be secured to structural member 302 via ties 314 and form attachments 206*a* as also discussed in greater detail above with respect to FIGS. 3A through 3I.

The erection equipment allows quick installation. Further, safety is facilitated by making a positive connection with the form before it is lifted and after it is secured to the existing structure or structure being built. Moreover, the equipment allows a tie off point to facilitate safety before form 100 is installed and/or during conventional construction of the interior bridge deck bay when such construction follows the installation of form 100. However, the forms of the present invention may be installed utilizing other methods than that described herein without departing from the scope of the present invention.

Figure 5:
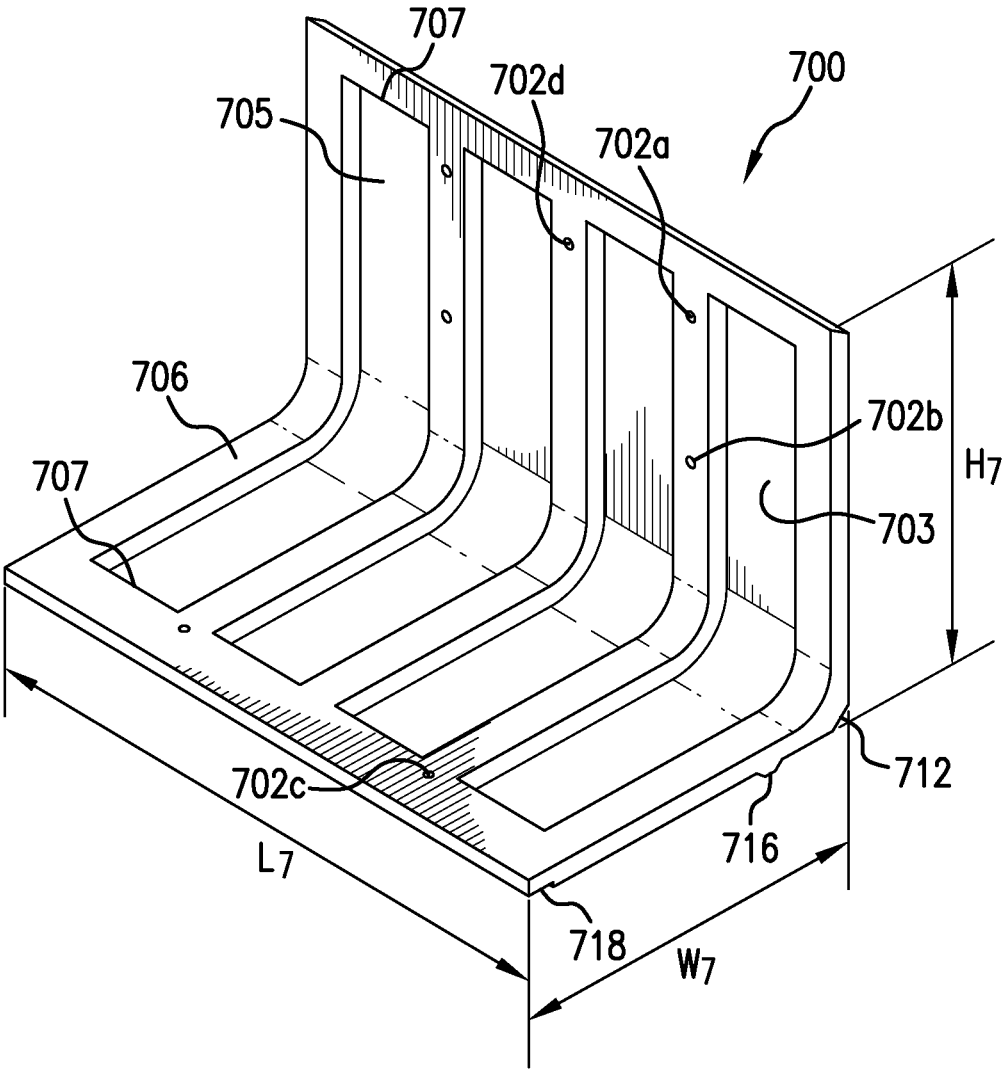
FIG. 5 depicts a perspective view of a stay-in-place fascia form having a plurality of recesses in accordance with one alternate embodiment of the present invention.
Figure 6:
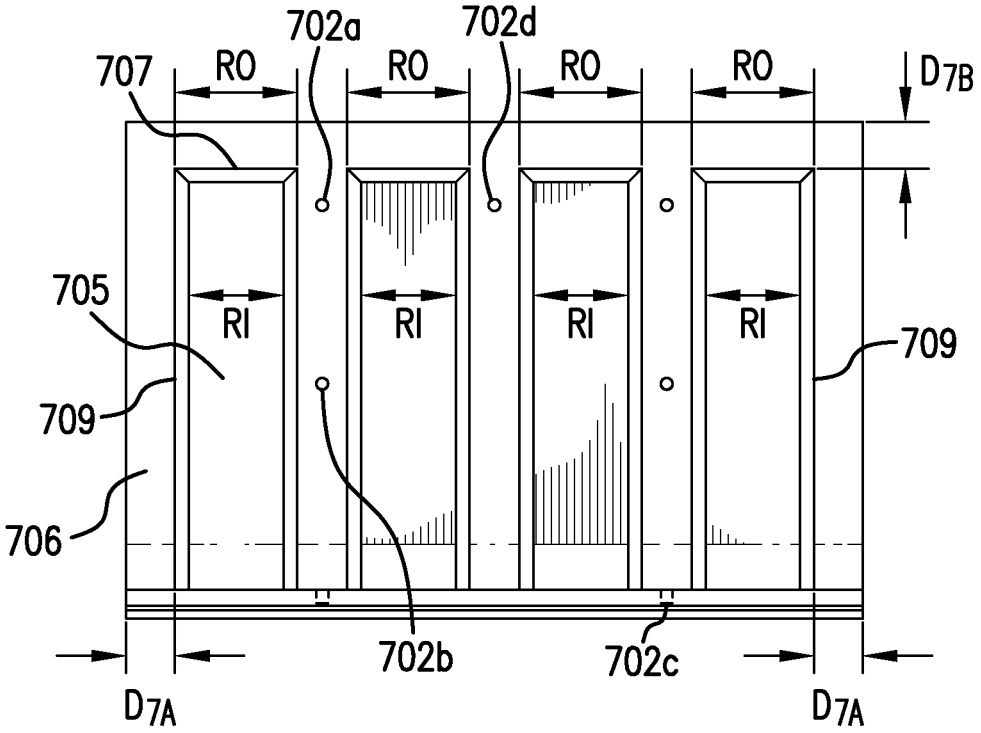
FIG. 6 depicts an elevational view of a stay-in-place fascia form having a plurality of recesses in accordance with the alternate embodiment of the present invention depicted in FIG. 5.
Figure 7:
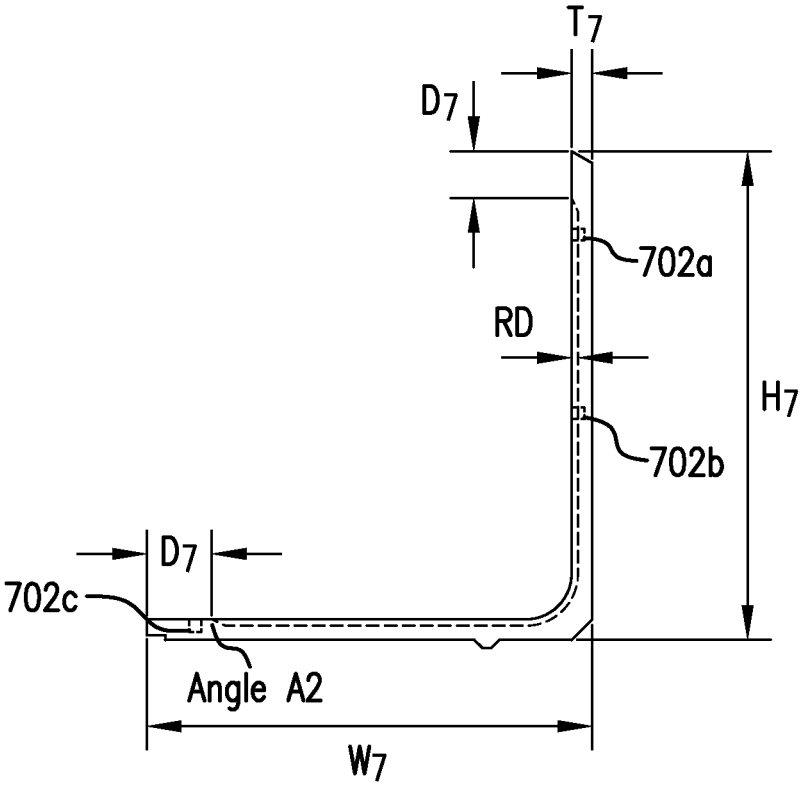
FIG. 7 depicts a side view of a stay-in-place fascia form having a plurality of recesses in accordance with the alternate embodiment of the present invention depicted in FIGS. 5 and 6.

Turning now to FIGS. 5 through 7, depicted are perspective, plan, and side views of stay-in-place fascia form 700 having a plurality of recesses 703 in accordance with one alternate embodiment of the present invention. Recesses 703 decrease the weight of form 700. Although four (4) recesses 703 are illustrated, varying quantities may be substituted without departing from the scope hereof.

In the depicted embodiment, the features of form 700 including, without limitation, inserts 702, interior surface 706, bevel 712, protrusion 716, and rabbet 718 are substantially identical to the equivalent components of form 100, namely, inserts 202, interior surface 106, bevel 212, protrusion 216, and rabbet 218 as discussed above. That is, the only substantial difference between form 100 and form 700 is that the latter includes recesses 703 and the dimensions thereof have been altered to accommodate recesses 703 while maintaining the structural integrity of form 700.

More specifically, height $H_7$ of form 700 is approximately forty one inches (41"), width $W_7$ is approximately thirty seven and one half inches (37½"), and length $L_1$ is approximately sixty inches (60"), however, varied dimensions may be substituted to accommodate, for example, desired size of the structure being built, material strength and geometric boundaries, and/or varying recess sizes and/or quantities.

Form 700 has a thickness $T_7$ of approximately three inches (3"); however, alternate thicknesses may be substituted without departing from the scope of the present invention.

As best seen in the plan view of FIG. 6, recesses 703 have a recess outer width RO of approximately ten inches (10") and a recess inner width RI of approximately eight inches (8"). That is, the interior surfaces surrounding the perimeter of recesses 703 slope inward at an Angle A2 of approximately 45 degrees as such surfaces extend from interior surface 706 of form 700 to interior surface 705 of recess 703. Such angle is best seen in the side view of FIG. 7. Also, the outer latitudinal edges 707 of recesses 703 are located at a distance $D_{7B}$ of approximately four inches from the latitudinal edges of interior surface 706. Similarly, the outer longitudinal edges 709 of the two outermost recesses 703 are located at a distance $D_{7A}$ of approximately four inches from the longitudinal edges of interior surface 706. Recesses 703 have a depth RD of approximately one inch (1"). All of the aforementioned dimensions and angles illustrate one embodiment of the present invention, however, varying dimensions and/or angles may be substituted without departing from the scope hereof.

Figure 8A:
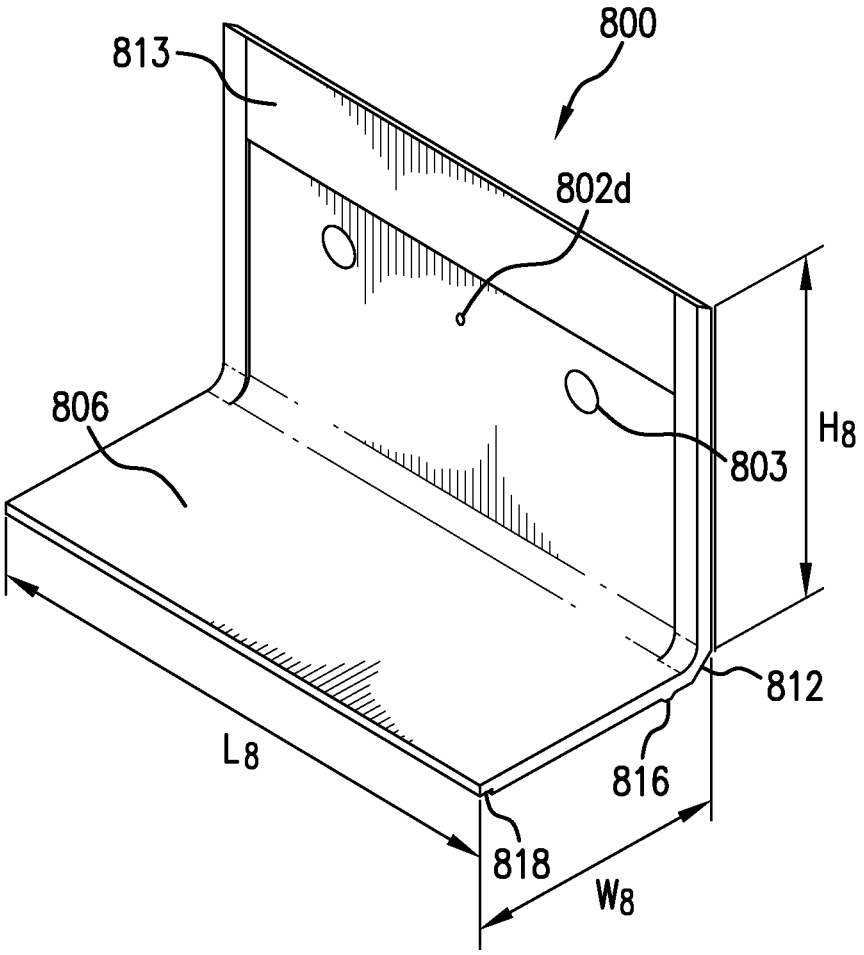
FIG. 8A depicts a perspective view of a stay-in-place fascia form having a plurality of apertures and a recess in accordance with one alternate embodiment of the present invention.
Figure 8B:
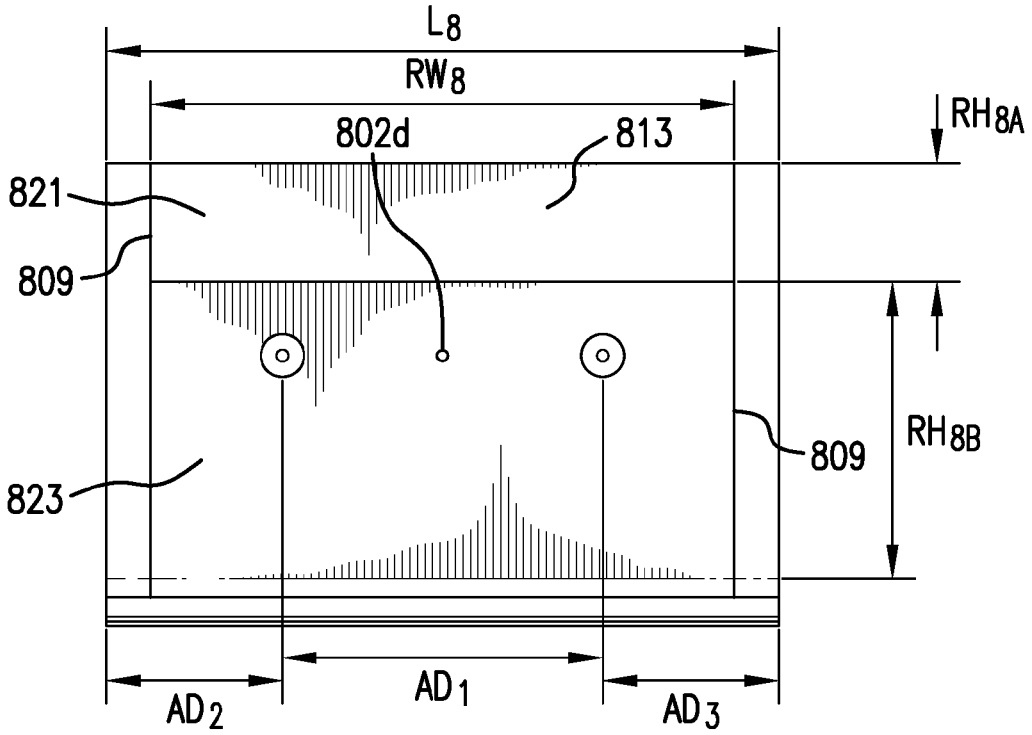
FIG. 8B depicts an elevational view of a stay-in-place fascia form having a plurality of apertures and a recess in accordance with the alternate embodiment of the present invention depicted in FIG. 8A.
Figure 8C:
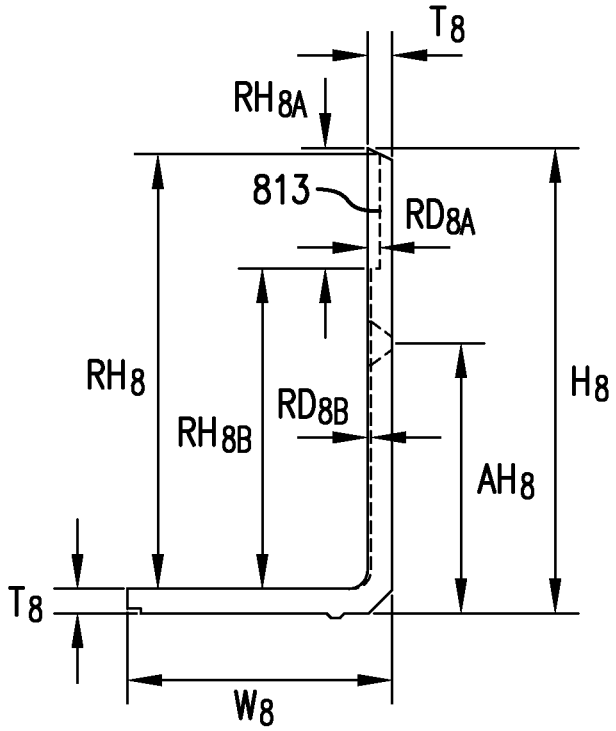
FIG. 8C depicts a side view of a stay-in-place fascia form having a plurality of apertures and a recess in accordance with the alternate embodiment of the present invention depicted in FIGS. 8A and 8B.

Referring next to FIGS. 8A through 8C, depicted are perspective, plan, and side views of stay-in-place fascia form 800 having a pair of apertures 803 and a recess 813 in accordance with one alternate embodiment of the present invention. Apertures 803 allow the form to be secured in place by a coupler such as a rod or the like. That is, a first end of the coupler is coupled to the structural member on which form 800 sits via any one of a plurality of methods known in the art. The second end of the coupler passes through a respective aperture 803. Thereafter, fasteners (e.g., nuts and bolts) may be fastened to the second end of the coupler to prevent or minimize the possibility of the coupler disengaging itself from aperture 803. Although two (2) apertures 803 are illustrated, varying quantities may be substituted without departing from the scope hereof.

Recesses 813 decrease the weight of form 800. Although one (1) substantially rectangular, bi-level recess 813 is illustrated, varying quantities and/or shapes may be substituted without departing from the scope hereof.

In the depicted embodiment, the features of form 800 including, without limitation, insert 802*d*, interior surface 806, bevel 812, protrusion 816, and rabbet 818 are substantially identical to the equivalent components of form 100, namely, insert 202*d*, interior surface 106, bevel 212, protrusion 216, and rabbet 218 as discussed above. That is, the only substantial difference between form 100 and form 800 is that the latter includes recess 813, apertures 803 in lieu of inserts 202, and the dimensions thereof have been altered.

More specifically, the height $H_8$ of form 800 is approximately forty one and 5/16 inches (41 5/16"), the width $W_8$ is approximately thirteen and 3/16 inches (13 3/16"), and the length $L_8$ is approximately sixty inches (60"), however, varied dimensions may be substituted to accommodate, for example, desired size of the structure being built, material strength and geometric boundaries, and/or varying aperture sizes and/or quantities.

Form 800 has a thickness $T_8$ of approximately two inches (2"); however, alternate thicknesses may be substituted without departing from the scope of the present invention.

As best seen in the plan view of FIG. 8B, recess 813 have a recess width $RW_8$ of approximately fifty four inches (54"). The longitudinal edges 809 of recess 813 are located approximately three inches (3") from the longitudinal edges of interior surface 806. Recess 813 has an overall recess height $RH_8$ of approximately thirty nine and 5/16 inches (39 5/16"). Recess 813 includes upper and lower rectangular sections 821 and 823, respectively, having recess depths $RD_{8A}$ and $RD_{8B}$ of approximately one inch (1") and one-half inch (½"), respectively. The width $RW_8$ of upper and lower rectangular sections 821 and 823, respectively, are both approximately fifty four inches (54"). The recess heights $RH_{8A}$ and $RH_{8B}$ are approximately ten and 3/16 inches (10 3/16") and twenty nine and one eighth inches (29⅛"), respectively. All of the aforementioned dimensions and angles illustrate one embodiment of the present invention, however, varying dimensions and/or angles may be substituted without departing from the scope hereof.

In the depicted embodiment, the center point of each aperture 803 is located at a height $AH_8$ of approximately two feet $(2')_{as}$ best seen in FIG. 8C. Additionally, the center points of the two apertures 803 are located at a distance $AD_1$ of approximately thirty inches (30") from each other and at a distance $AD_2$ of approximately fifteen inches (15") from the longitudinal edge of interior surface 806 and a distance $AD_3$ of approximately twelve inches from longitudinal edge 809 of recess 813 as depicted in FIG. 8B. However, varying locations and/or quantities of aperture 803 may be substituted without departing from the scope hereof.

As best seen in FIG. 8C, apertures 803 have a frusto-conical shape, however, varying shapes may be substituted without departing from the scope hereof.

Figure 9A:
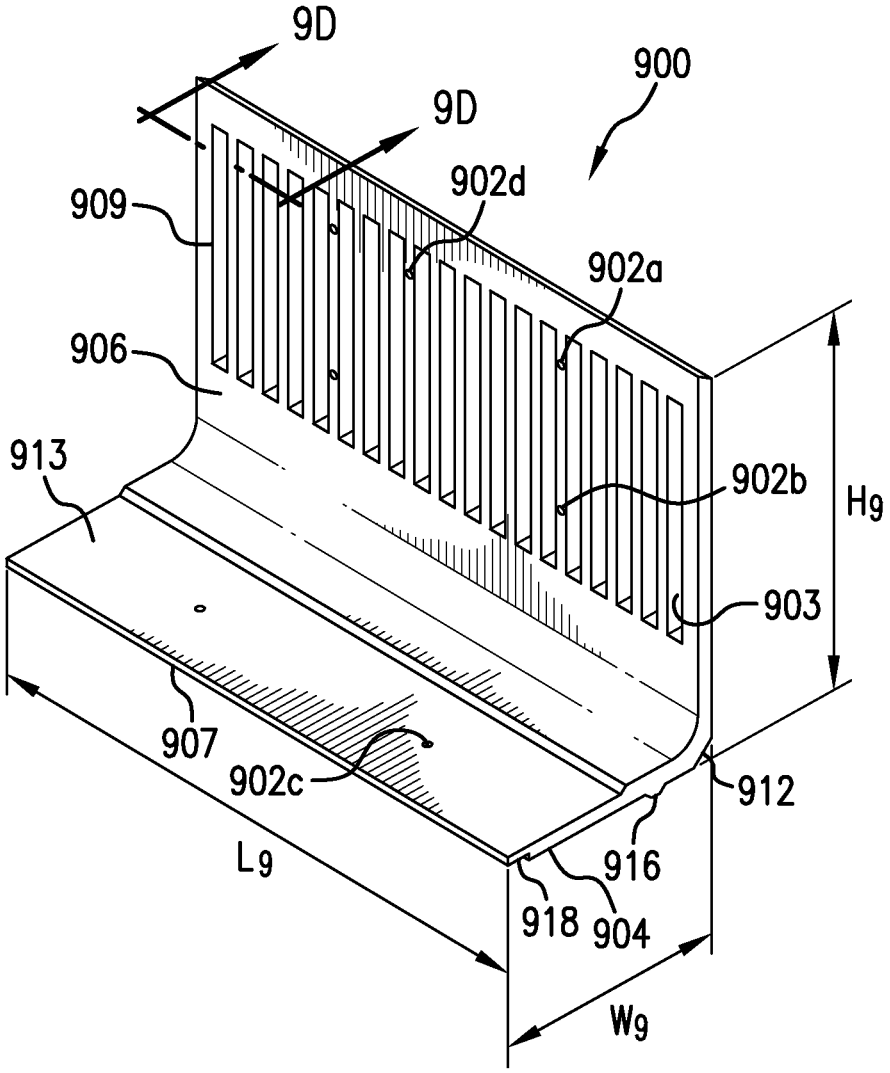
FIG. 9A depicts a perspective view of a stay-in-place fascia form having a plurality of vertical recesses and a horizontal recess in accordance with one alternate embodiment of the present invention.
Figure 9B:
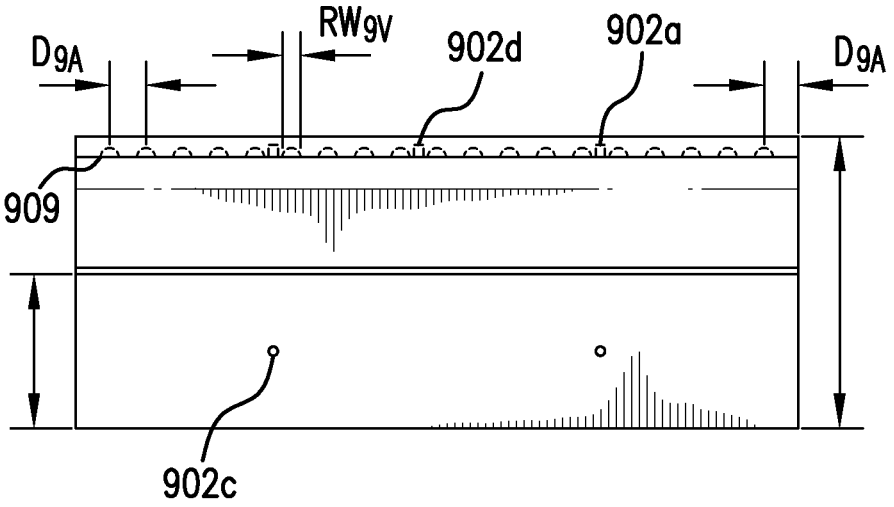
FIG. 9B depicts a plan view of a stay-in-place fascia form having a plurality of vertical recesses and a horizontal recess in accordance with the alternate embodiment of the present invention depicted in FIG. 9A.
Figure 9D:
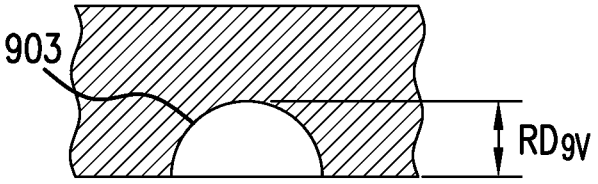
FIG. 9D depicts a cross-sectional view of the vertical recess depicted in FIGS. 9A through 9C as taken along lines 9D-9D of FIG. 9A.
Figure 9C:
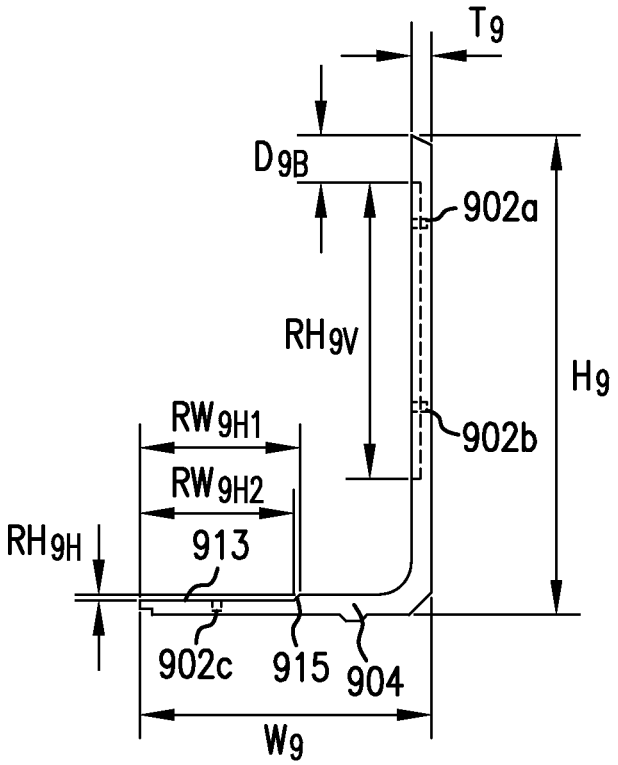
FIG. 9C depicts a side view of a stay-in-place fascia form having a plurality of vertical recesses and a horizontal recess in accordance with the alternate embodiment of the present invention depicted in FIGS. 9A and 9B.

Turning now to FIGS. 9A through 9C, depicted are perspective, plan, side, and cross-sectional views of stay-in-place fascia form 900 having a plurality of vertical recesses 903 and a horizontal recess 913 in accordance with one alternate embodiment of the present invention. Recesses 903 and 913 decrease the weight of form 900. Although nineteen (19) vertical recesses 903 and one (1) horizontal recess 913 are illustrated, varying quantities may be substituted without departing from the scope hereof.

In the depicted embodiment, the features of form 900 including, without limitation, inserts 902, horizontal component 904, interior surface 906, bevel 912, protrusion 916, and rabbet 918 are substantially identical to the equivalent components of form 100, namely, inserts 202, horizontal component 104, interior surface 106, bevel 212, protrusion 216, and rabbet 218 as discussed above. That is, the only substantial difference between form 100 and form 900 is that the latter includes vertical recesses 903, horizontal recess 913, and the dimensions thereof have been altered to accommodate recesses 903 and 913 while maintaining the structural integrity of form 900.

More specifically, height $H_9$ of form 900 is approximately forty one inches and five sixteenths inches (41 5/16"), width $W_9$ is approximately twenty five inches (25"), and length $L_9$ is approximately sixty inches (60"), however, varied dimensions may be substituted to accommodate, for example, desired size of the structure being built, material strength and geometric boundaries, and/or varying recess sizes and/or quantities.

Form 900 has a thickness $T_9$ of approximately two inches (2"); however, alternate thicknesses may be substituted without departing from the scope of the present invention.

As best seen in the plan view of FIG. 9B, vertical recesses 903 have a recess width $RW_{9V}$ of approximately three quarters of an inch (¾") and a semicircular cross section, the latter of which is best seen in the cross-sectional view of FIG. 9D. The longitudinal centerlines of each vertical recess 903 are located equidistantly at a distance $D_{9A}$ of approximately three inches (3") from all other recess longitudinal centerlines and the longitudinal edges of interior surface 906. Also, the outer latitudinal edges 907 of vertical recesses 903 are located at a distance $D_{9B}$ of approximately four inches from the latitudinal edges of interior surface 906. Similarly, as also stated above, the outer longitudinal edges 909 of the two outermost recesses 903 are located at a distance $D_{9A}$ of approximately four inches from the longitudinal edges of interior surface 906. Recesses 703 have a depth $RD_{9V}$ of approximately three eighths of an inch (⅜") and a height $RH_{9V}$ of approximately twenty five and one-sixteenth inches (25 1/16"). All of the aforementioned dimensions and angles illustrate one embodiment of the present invention, however, varying dimensions and/or angles may be substituted without departing from the scope hereof.

As best seen in the perspective and side views of FIGS. 9A and 9C, recess 913 is located in horizontal component 904 and has a length approximately equivalent to the length $L_9$ of form 900. The width of recess 913 extends from the distal longitudinal edge 907 of horizontal component 904 inward at a width $RW_{9H}$ of approximately fourteen and one quarter inches (14¼"). Recess side surface 915 is angled downward as it extends outward at an angle of approximately 45 degrees (45°), thereby decreasing the width of recess 913 to a width $RW_{9H2}$ of approximately thirteen and three quarters inches (13¾") on its bottommost surface. The recess height $RH_{9H}$ is one half inch (½"). All of the aforementioned dimensions and angles illustrate one embodiment of the present invention, however, varying dimensions and/or angles may be substituted without departing from the scope hereof.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. We claim a form for creation of a structure, the form for supporting uncured concrete prior to curing comprising:

a substantially vertical component, said substantially vertical component having a substantially vertical inwardly facing surface and a substantially vertical outwardly facing surface;

a substantially horizontal component having a substantially horizontal inwardly facing surface and a substantially horizontal outwardly facing surface, said substantially vertical component located substantially perpendicular to said substantially horizontal component and extending upwardly from said horizontal component, the substantially vertical component and the substantially horizontal component forming an L shape;

at least one insert in or through at least one of the group consisting of the substantially vertical inwardly facing surface, the substantially horizontal inwardly facing surface; and combinations thereof;

a rabbet extending longitudinally along the substantially horizontal component, the rabbet recessed in said substantially horizontal outwardly facing surface at the distal end thereof; and an interconnection clip.

2. A form according to claim 1, further comprising:

at least one form attachment configured for mating with the at least one insert.

3. A form according to claim 2, wherein said at least one form attachment is an exterior reinforcement.

4. A form according to claim 1, wherein said at least one insert is threaded.

5. A form according to claim 1, wherein said interconnection clip includes at least one railing support.

6. A form according to claim 1, further comprising:

at least one of the group consisting of an interior reinforcement, an ornamental feature, and combinations thereof.

7. A form according to claim 1, wherein a thickness of said substantially horizontal component and said substantially vertical component is approximately two inches.

8. A form according to claim 1, wherein an upwardly facing surface of said substantially vertical component inclines upwardly and inwardly toward said form interior surface at an angle of approximately thirty degrees.

9. A form according to claim 1, further comprising:

a joining component.

10. A form according to claim 9, wherein said joining component extends at an angle of 45 degrees relative to said substantially vertical inwardly facing surface and said substantially horizontal inwardly facing surface.

11. A form according to claim 1, wherein an upper corner of a distal end of said substantially horizontal component is rounded.

12. A form according to claim 1, further comprising:

a protrusion extending longitudinally from said substantially horizontal outwardly facing surface.

13. A form according to claim 12, wherein the protrusion has a semicircular cross section.

14. A form according to claim 12, wherein said protrusion is located at the approximate midpoint of a proximal half of said substantially horizontal component.

15. A form according to claim 1, wherein said rabbet is substantially L-shaped.

16. We claim a form for creation of a structure, the form for supporting uncured concrete prior to curing comprising:

a substantially vertical component, said substantially vertical component having a substantially vertical inwardly facing surface and a substantially vertical outwardly facing surface;

a substantially horizontal component having a substantially horizontal inwardly facing surface and a substantially horizontal outwardly facing surface, said substantially vertical component located substantially perpendicular to said substantially horizontal component and extending upwardly from said horizontal component, the substantially vertical component and the substantially horizontal component forming an L shape;

at least one insert in or through at least one of the group consisting of the substantially vertical inwardly facing surface, the substantially horizontal inwardly facing surface; and combinations thereof; and a rabbet extending longitudinally along the substantially horizontal component, the rabbet recessed in said substantially horizontal outwardly facing surface at the distal end thereof; and a bevel extending longitudinally along the intersection of the substantially vertical outwardly facing surface and the substantially horizontal outwardly facing surface.

17. A form according to claim 16, wherein said bevel is located at an angle of 45 degrees relative to said substantially vertical outwardly facing surface and said substantially horizontal outwardly facing surface.

18. A form according to claim 16, wherein an upper corner of a distal end of said substantially horizontal component is rounded.

19. A form according to claim 16, further comprising:

a protrusion extending longitudinally from said substantially horizontal outwardly facing surface.

20. A form according to claim 19, wherein the protrusion has a semicircular cross section.

21. A form according to claim 19, wherein said protrusion is located at the approximate midpoint of a proximal half of said substantially horizontal component.

* * * * *